US011203198B2

(12) United States Patent
Hirukawa et al.

(10) Patent No.: US 11,203,198 B2
(45) Date of Patent: Dec. 21, 2021

(54) PRINTING APPARATUS AND ACCOMMODATION APPARATUS

(71) Applicant: FUJI CORPORATION, Chiryu (JP)

(72) Inventors: Ritsuo Hirukawa, Nishio (JP); Takeshi Kondo, Chiryu (JP); Mitsuaki Kato, Anjo (JP); Atsushi Torii, Toyota (JP); Jun Iisaka, Nisshin (JP)

(73) Assignee: FUJI CORPORATION, Chiryu (JP)

( * ) Notice: Subject to any disclaimer, the term of this patent is extended or adjusted under 35 U.S.C. 154(b) by 214 days.

(21) Appl. No.: 16/462,340

(22) PCT Filed: Dec. 5, 2016

(86) PCT No.: PCT/JP2016/086102
§ 371 (c)(1),
(2) Date: May 20, 2019

(87) PCT Pub. No.: WO2018/105016
PCT Pub. Date: Jun. 14, 2018

(65) Prior Publication Data

US 2019/0337290 A1 Nov. 7, 2019

(51) Int. Cl.
*B41F 35/00* (2006.01)

(52) U.S. Cl.
CPC ..... *B41F 35/005* (2013.01)

(58) Field of Classification Search
CPC ..... B41F 35/005
(Continued)

(56) References Cited

U.S. PATENT DOCUMENTS 5,176,076 A * 1/1993 Azuma ..... B41F 15/0818 101/123
5,176,078 A * 1/1993 Homma ..... B41F 15/12 101/126

(Continued)

FOREIGN PATENT DOCUMENTS

EP 2 818 320 A1 12/2014
JP 4-107146 A 4/1992

(Continued)

OTHER PUBLICATIONS

International Search Report dated Feb. 28, 2017 in PCT/JP2016/086102 filed on Dec. 5, 2016.

(Continued)

*Primary Examiner* — Anthony H Nguyen
(74) *Attorney, Agent, or Firm* — Oblon, McClelland, Maier & Neustadt, L.L.P.

(57) ABSTRACT

A printing apparatus of the present disclosure is for performing printing of a viscous fluid onto a print target using a screen mask, the printing apparatus including: a moving section configured to perform at least one of moving an exchangeable member to an exchange position or loading and unloading of the exchangeable member, for at least two types of the exchangeable member that, out of a cartridge configured to house the viscous fluid, a squeegee, a screen mask, a cleaning member used to clean the screen mask, and a support member configured to fix the print target, include at least one out of the cartridge, the squeegee, and the cleaning member; and an exchange control section configured to control the moving section to perform exchange processing of exchanging the exchangeable member.

6 Claims, 17 Drawing Sheets

(58) Field of Classification Search
USPC ..... 101/123
See application file for complete search history.

(56) References Cited

U.S. PATENT DOCUMENTS

| | | | | | |
|---|---|---|---|---|---|
| 5,361,694 | A * | 11/1994 | Dubuit | B41F 15/0804 | 101/115 |
| 6,152,031 | A * | 11/2000 | DeCruz | B41F 15/0813 | 101/115 |
| 6,237,490 | B1 * | 5/2001 | Takahashi | H05K 3/1233 | 101/129 |
| 2005/0183600 | A1 * | 8/2005 | Perault | H05K 3/1216 | 101/425 |
| 2014/0190361 | A1 * | 7/2014 | Satou | B41F 15/26 | 101/126 |
| 2015/0009524 | A1 * | 1/2015 | Fujimoto | G06K 15/40 | 358/1.14 |
| 2018/0065357 | A1 * | 3/2018 | Mantani | B41F 15/36 | |
| 2018/0244037 | A1 * | 8/2018 | Chen | B41F 35/005 | |

FOREIGN PATENT DOCUMENTS

| | | | |
|---|---|---|---|
| JP | 6-71847 | A | 3/1994 |
| JP | 7-186362 | A | 7/1995 |
| JP | 2004-281518 | A | 10/2004 |
| JP | 2007-261147 | A | 10/2007 |
| WO | WO 2014/030212 | A1 | 2/2014 |
| WO | WO 2014/091546 | A1 | 6/2014 |

OTHER PUBLICATIONS

Extended European Search Report dated Nov. 4, 2019 in European Patent Application No. 16923356.6, 8 pages.

* cited by examiner

PRINTING APPARATUS AND ACCOMMODATION APPARATUS

TECHNICAL FIELD

The present disclosure relates to a printing apparatus and an accommodation apparatus.

BACKGROUND ART

Conventionally, in a printing apparatus that performs printing of a viscous fluid using a screen mask onto a print target such as a board, there is an apparatus that performs automatic exchange of the screen mask. For example, disclosed in patent literature 1 is a printing apparatus provided with a rod that protrudes downwards, and a sliding member that, by sliding the rod, slides the screen mask and pushes it to a main body frame.

CITATION LIST

Patent Literature

Patent literature 1: JP-A-H04-107146

BRIEF SUMMARY

Technical Problem

However, in a printing apparatus, there are members that need to be exchanged other than a screen mask, such as a squeegee. Conventionally, exchange of such members is performed manually by an operator. This leads to a problem of troublesome exchange work for an operator.

The present disclosure solves the above problems and an object thereof is to enable automatic exchange of exchangeable members of a printing apparatus.

Solution to Problem

The present disclosure employs the following means to achieve the above object.

A printing apparatus of the present disclosure is for performing printing of a viscous fluid onto a print target using a screen mask, the printing apparatus including:

a moving section configured to perform at least one of moving an exchangeable member to an exchange position or loading and unloading of the exchangeable member, for at least two types of the exchangeable member that, out of a cartridge configured to house the viscous fluid, a squeegee, a screen mask, a cleaning member used to clean the screen mask, and a support member configured to fix the print target, include at least one out of the cartridge, the squeegee, and the cleaning member; and an exchange control section configured to control the moving section to perform exchange processing of exchanging the exchangeable member.

The printing apparatus is provided with a moving section configured to perform, with respect to each of at least two types of exchangeable members, at least one of moving of the exchangeable member to an exchange position and loading or unloading of the exchangeable member. Further, the printing apparatus is configured to perform exchange processing of exchanging the exchangeable member using the moving section. Thus, the printing apparatus is able to perform automatic exchange of at least two types of exchangeable members. Here, an "exchange position" includes a transfer position and a receive position.

DESCRIPTION OF EMBODIMENTS

Figure 1:
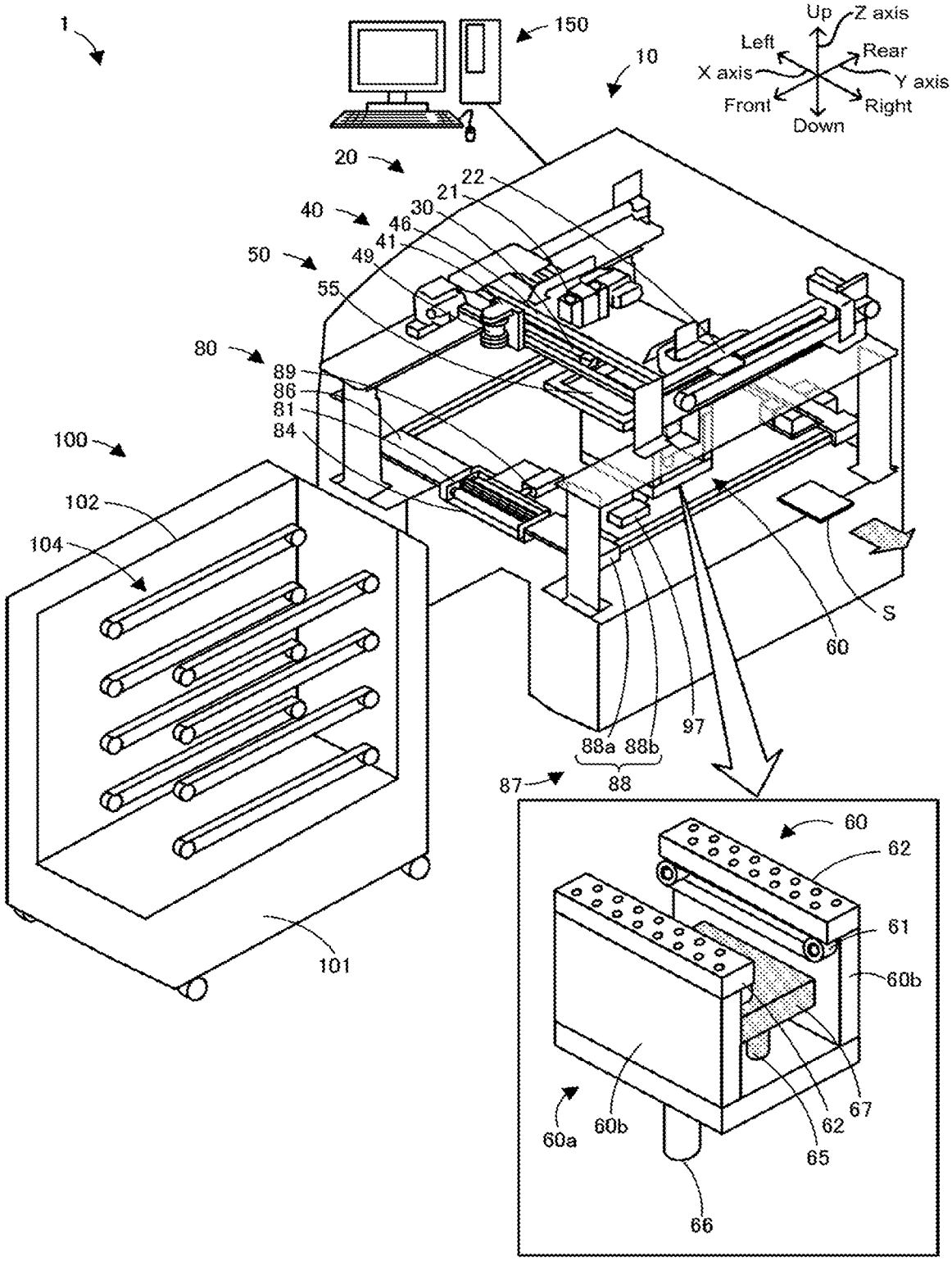
FIG. 1 shows an example of the overall configuration of printing system 1.
Figure 2:
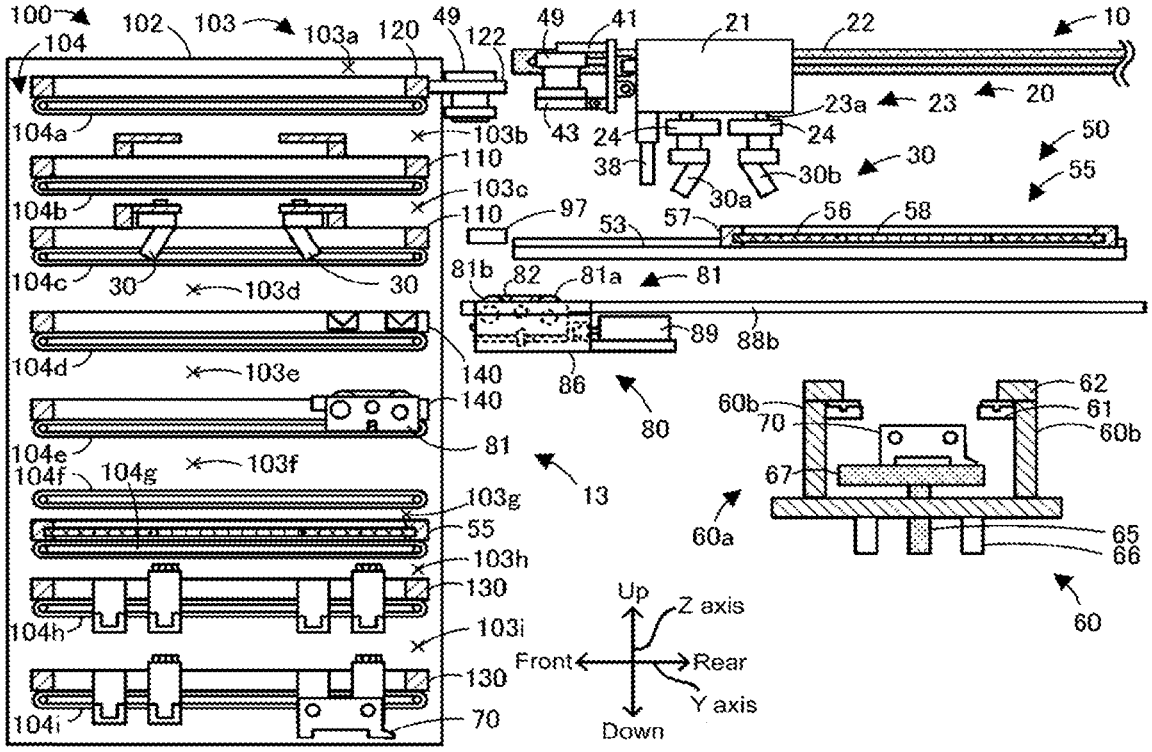
FIG. 2 is a cross section of printing apparatus 10 and accommodation apparatus 100.
Figure 3:
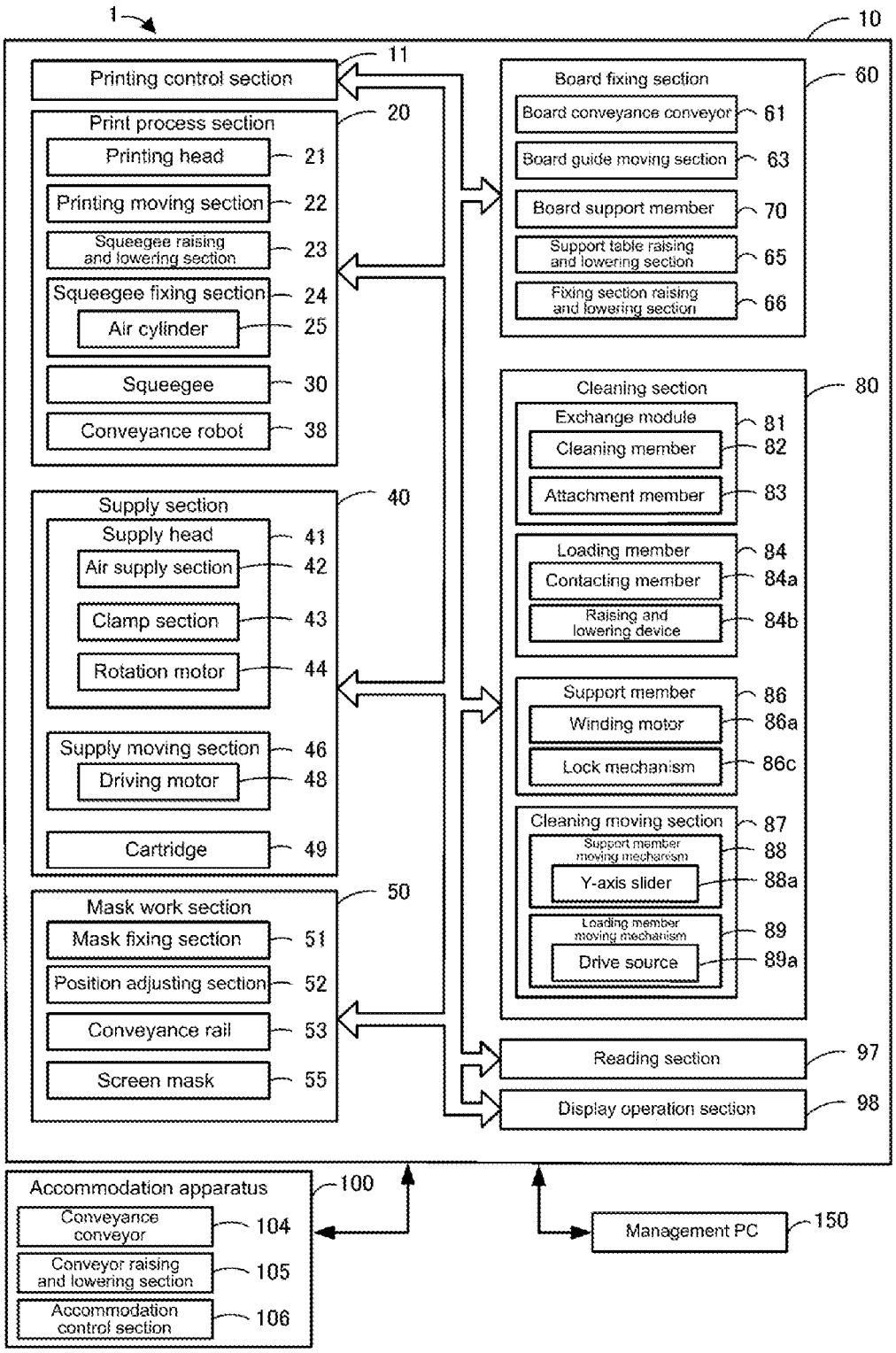
FIG. 3 is a block diagram showing electrical connections of printing system 1.
Figure 4:
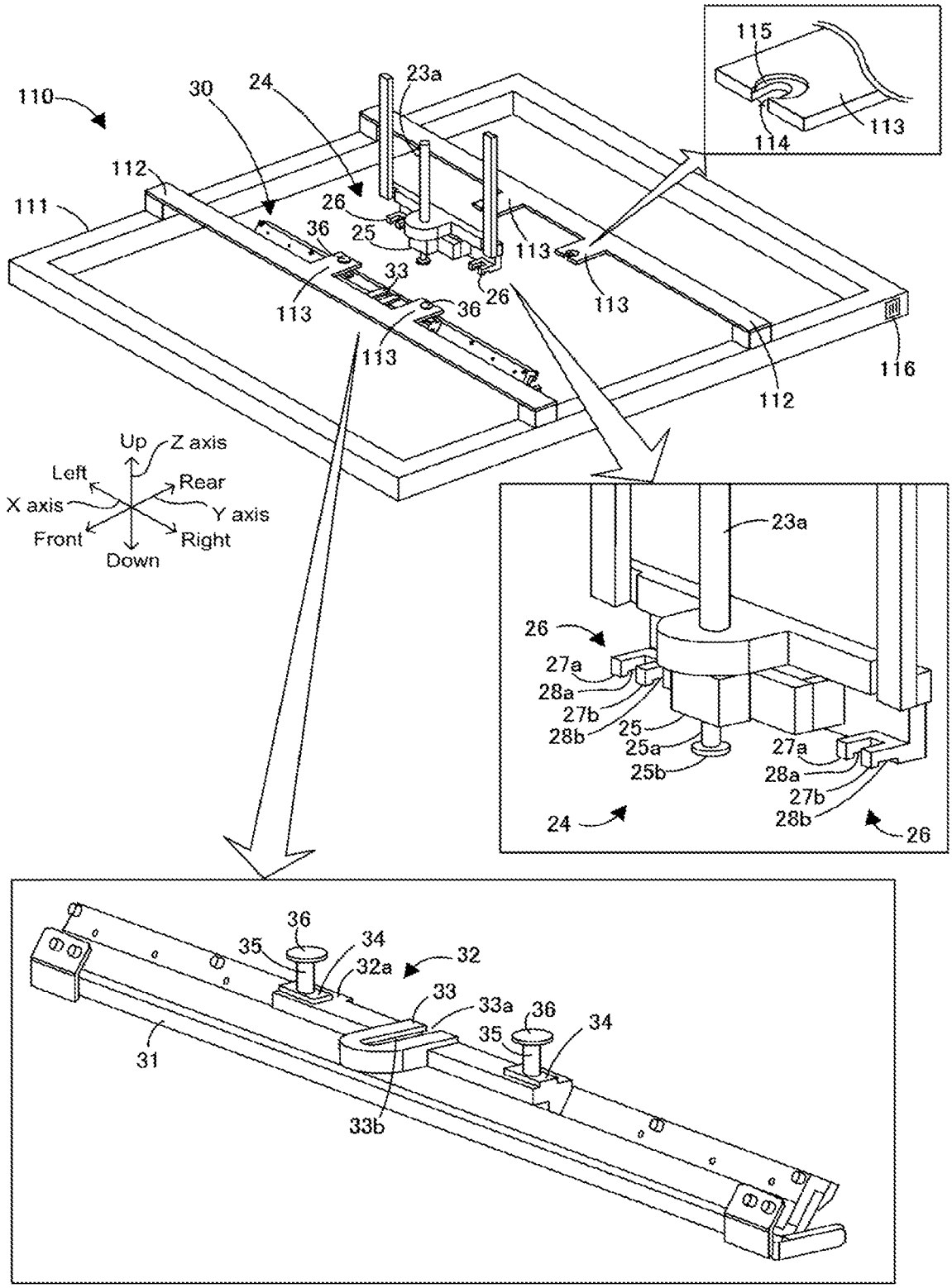
FIG. 4 is a perspective view of squeegee fixing section 24, squeegee 30, and squeegee conveyance jig 110.
Figure 5:
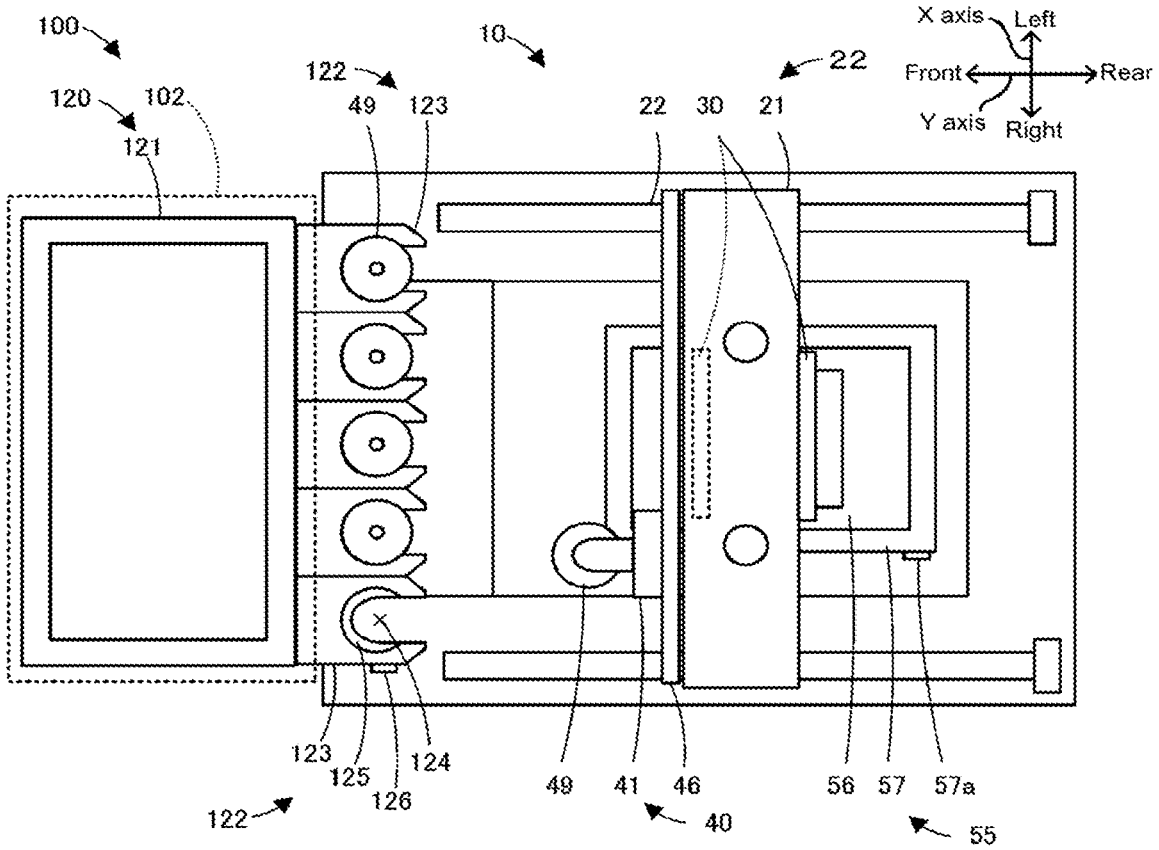
FIG. 5 is a plan view of supply section 40 and cartridge conveyance jig 120.
Figure 6:
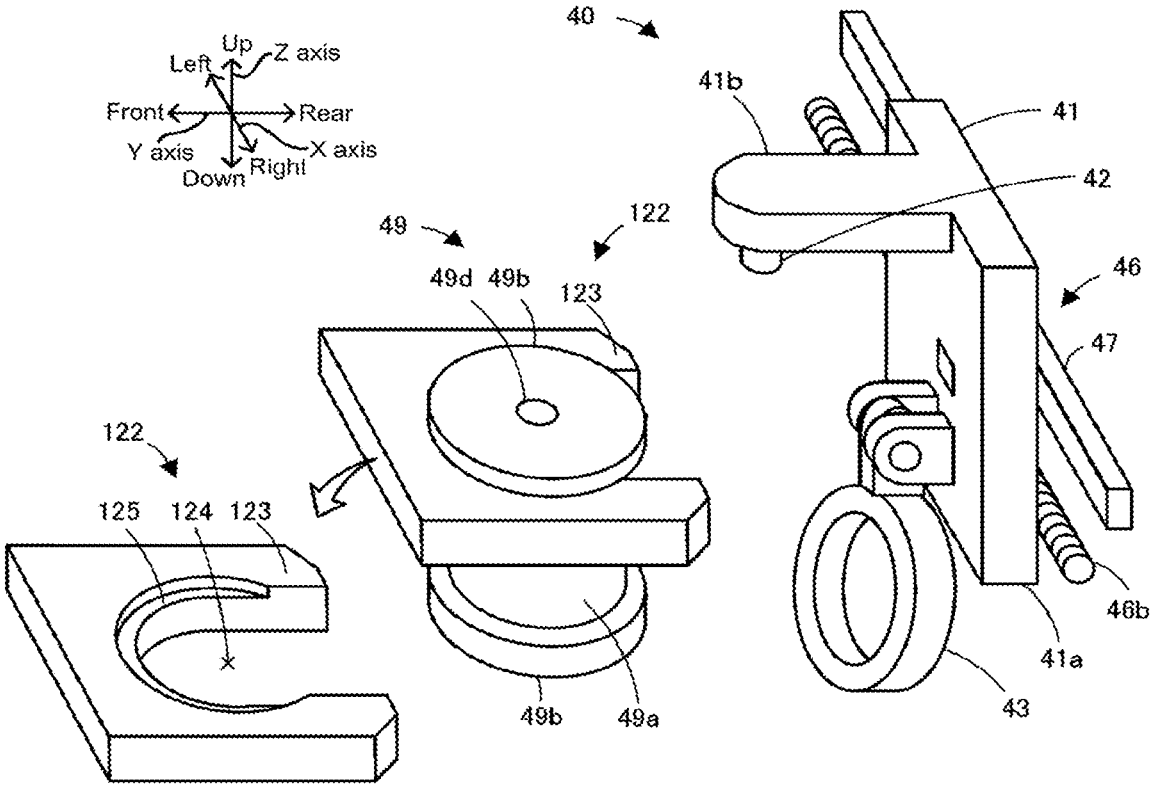
FIG. 6 is a perspective view of supply section 40 and holder 122.
Figure 7:
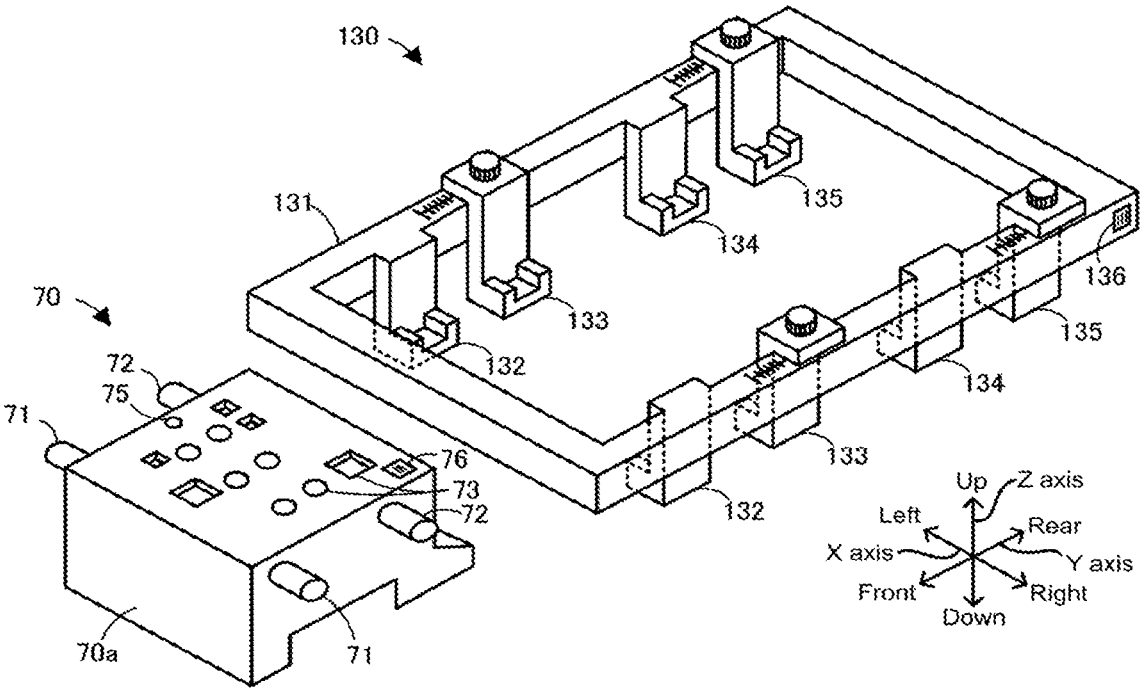
FIG. 7 is a perspective drawing of board support member 70 and support member conveyance jig 130.
Figure 8:
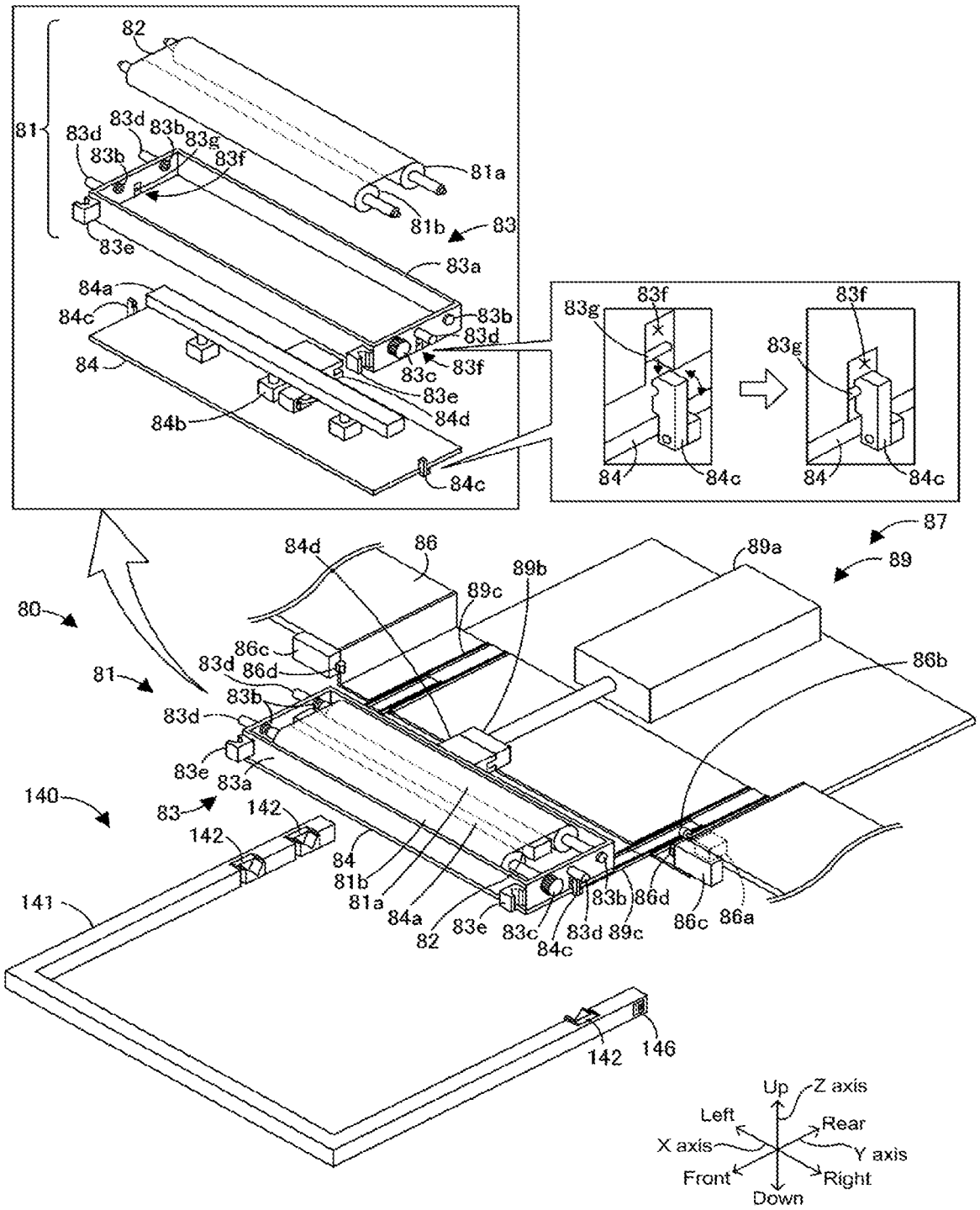
FIG. 8 is a perspective view of cleaning section 80 in a protruding state and cleaning member conveyance jig 140.
Figure 9:
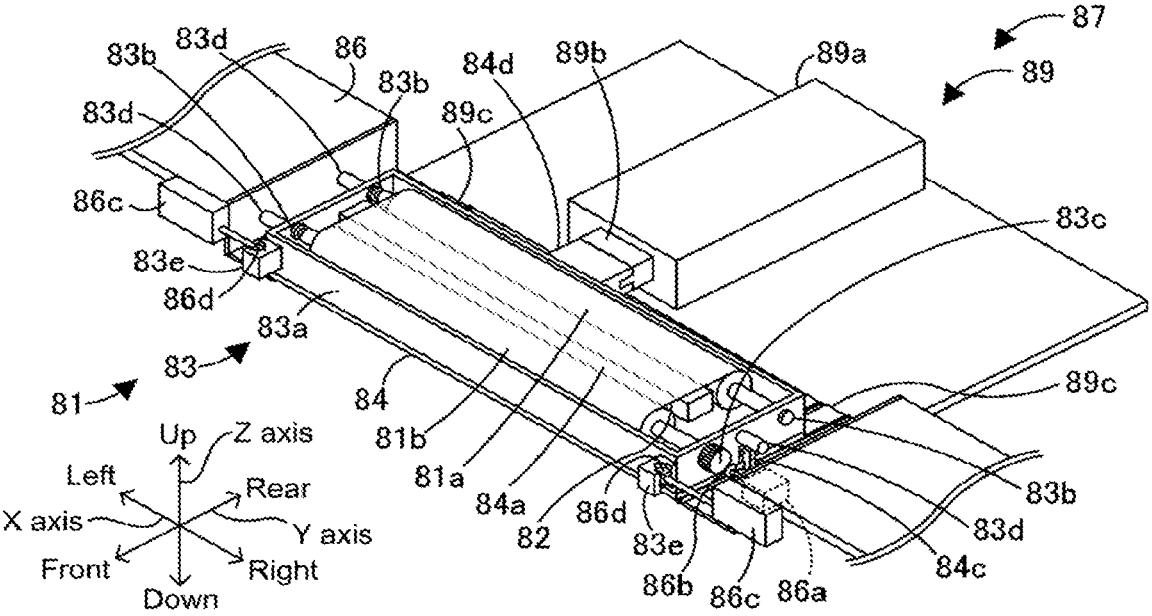
FIG. 9 is a perspective view of cleaning section 80 in a non-protruding state.

Embodiments of the present disclosure are described below with reference to the figures. FIG. 1 shows an example of the overall configuration of printing system 1 as an embodiment of the present disclosure. FIG. 2 is a cross section of printing apparatus 10 and accommodation apparatus 100. FIG. 3 is a block diagram showing electrical connections of printing system 1. FIG. 4 is a perspective view of squeegee fixing section 24, squeegee 30, and squeegee conveyance jig 110. FIG. 5 is a plan view of supply section 40 and cartridge conveyance jig 120. FIG. 6 is a perspective view of supply section 40 and holder 122. FIG. 7 is a perspective drawing of board support member 70 and support member conveyance jig 130. FIG. 8 is a perspective view of cleaning section 80 in a protruding state and cleaning member conveyance jig 140. FIG. 9 is a perspective view of cleaning section 80 in a non-protruding state. Printing system 1 is provided with printing apparatus 10 that performs printing of solder paste (also referred to as simply solder) as a viscous fluid onto a print target (here, board S) using screen mask 55. Printing system 1 is also provided with accommodation apparatus 100 that accommodates at least one type of exchangeable member 13 used in printing apparatus 10, and management computer (PC) 150 that performs management of information related to processing of printing apparatus 10. Note that, printing system 1 may be configured as a mounting system also provided with other board work devices such as component mounters, not shown, that mounting electronic components on board S. Besides solder, other examples of a viscous fluid include conductive paste and adhesive. Printing apparatus 10 is configured to perform automatic exchange of exchangeable members 13 used in a print process when performing changeover of the print target to a different type of board S. Examples of exchangeable members 13 include at least one type among cartridge 49 that accommodates solder, squeegee 30, cleaning member 82, screen mask 55, and board support member 70. Printing apparatus 10 of the present embodiment is configured to automatically exchange all five types of exchangeable members 13. Further, from these five types, exchange processing other than for screen mask 55 is performed using squeegee conveyance jig 110, cartridge conveyance jig 120, support member conveyance jig 130, and cleaning member conveyance jig 140 shown in FIG. 2. In the present embodiment, left-right directions (X axis), front-rear directions (Y axis), and up-down directions (Z axis) are set as shown in FIGS. 1 and 2.

Printing apparatus 10, as shown in FIGS. 1 and 2, performs application (printing) of solder onto board S through hole pattern 58 formed in screen mask 55 by using squeegee 30 to squeeze solder loaded on screen mask 55 through the hole pattern 58. Printing apparatus 10 is provided with printing control section 11 (an example of an exchange control section, shown in FIG. 3), print process section 20, supply section 40, mask work section 50, board fixing section 60, cleaning section 80, and reading section 97. Also, printing apparatus 10 is provided with display operation section 98 (FIG. 3) configured as an operation panel that displays items on a display screen and receives various inputs from an operator, and a communication section, not shown, that performs communication with other connected devices.

Printing control section 11 is configured from a microprocessor based around a CPU, and is provided with ROM that memorizes a processing program, RAM used as working memory, an HDD that memorizes various data, and so on. Printing control section 11 performs overall control of printing apparatus 10.

Print process section 20 is provided on an upper level of printing apparatus 10 and is a unit for performing a process of printing a viscous fluid on board S using screen mask 55. As shown in FIG. 3, print process section 20 is provided with printing head 21, printing moving section 22, squeegee raising and lowering section 23, squeegee fixing section 24, squeegee 30, and conveyance rod 38. Printing moving section 22 is for moving printing head 21 in a specified direction (here, a front-rear direction) and is provided with a guide formed in the front-rear direction, a slider that moves along the guide, and a motor that drives the slider. Squeegee raising and lowering section 23 is configured as an air cylinder including piston rod 23*a* (FIGS. 2 and 4), and raises and lowers squeegee fixing section 24 and squeegee 30 by raising and lowering piston rod 23*a*. Print process section 20 includes two squeegees 30, first and second squeegees 30*a* and 30*b*, and correspondingly includes two piston rods 23*a* and two squeegee fixing sections 24.

The two squeegee fixing sections 24 are configured the same except for being arranged oppositely at the front and rear, thus, descriptions are only given for the front squeegee fixing section using FIG. 4. FIG. 4 shows a state before squeegee 30 is attached to squeegee fixing section 24, and in FIG. 4 squeegee 30 is attached to squeegee conveyance jig 110 used for squeegee exchange processing, which is described later.

Squeegee fixing section 24 is configured to perform switching of a squeegee 30 (here, first squeegee 30*a*) to and from a fixed state in which squeegee 30 is fixed and a released state in which squeegee 30 is not fixed. As shown in FIG. 4, squeegee fixing section 24 is connected to a lower end of piston rod 23*a*, and is provided with air cylinder 25 and regulating member 26. Air cylinder 25 is a mechanism for raising and lowering cylinder shaft 25*a* that protrudes downwards. Flange 25*b* is formed at a lower end of cylinder shaft 25*a*, and the upper surface of flange 25*b* is formed to support squeegee 30 from below. Regulating member 26 engages with protruding section 34 of squeegee 30 in a fixed state to regulate front-rear movement of squeegee 30. One regulating member 26 is provided on the left and right sides of air cylinder 25. Each regulating member 26 includes claw sections 27*a* and 27*b* that protrude to the front. Recesses 28*a* and 28*b* that face up are formed on the lower surfaces of claw sections 27*a* and 27*b*. With squeegee fixing section 24, a state in which air cylinder 25 has raised flange 25*b* is a fixed state, and a state in which air cylinder has lowered flange 25*b* relative to the fixed state is a released state. By this raising and lowering of flange 25*b*, squeegee fixing section 24 sandwiches attachment member 32 of squeegee 30 between the lower surface of regulating member 26 and the upper surface of flange 25*b* in the fixed state. Further, in a released state, squeegee fixing section 24 releases the fixing of squeegee 30 by relatively moving flange 25*b* and regulating member 26 in a vertical direction compared to the fixed state.

As shown in FIG. 4, squeegee 30 is provided with squeegee blade 31 formed longer to the left and right than hole pattern 58 (FIG. 2), and attachment member 32 for attaching squeegee blade 31 to squeegee fixing section 24. Attachment member 32 is provided with positioning member 33, protruding section 34, shaft member 35, and flange section 36. Positioning member 33 is formed in a U-shape as seen from above, and includes opening section 33*a* through which cylinder shaft 25*a* of squeegee fixing section 24 can pass through, and held surface 33*b* that protrudes horizontally towards opening section 33*a* that is a lower surface of positioning member 33 (towards the inside of the U shape). When cylinder shaft 25*a* of squeegee fixing section 24 is inserted inside opening section 33*a* of positioning member 33 towards the front, the upper surface of flange 25*b* faces held surface 33*b* in the vertical direction. This held surface 33*b* and held surface 32*a* that is the upper surface of attachment member 32 are configured such that squeegee 30 is fixedly held in squeegee fixing section 24 by being sandwiched between the upper surface of cylinder shaft 25*a* of squeegee fixing section 24 and the lower surface of regulating member 26. One protruding section 34 each is provided on the left and right side positioning members 33, and the protruding sections 34 are configured to engage with regulating member 26 by being inserted into recesses 28*a* and 28*b* of squeegee fixing section 24. By the engagement of regulating member 26 and protruding section 34, the movement of squeegee 30 in the front-rear direction with respect to squeegee fixing section 24 is regulated. One shaft member 35 each is provided for the left and right positioning members 33, and each shaft member 35 protrudes up from the upper surface of protruding section 34. Flange sections 36 are respectively formed on the upper ends of shaft members 35. Flange section 36 is for engaging with engaging section 115 of squeegee conveyance jig 110.

FIG. 4 also shows squeegee conveyance jig 110 used in automatic exchange of squeegee 30 by printing apparatus 10. Squeegee conveyance jig 110 is provided with frame 111, holder 112 to which squeegee 30 can be attached, and barcode 116 provided near the rear end at the right side of frame 111. Squeegee conveyance jig 110 is provided with two holders 112 that are symmetrical in a front-rear direction. Each holder 112 is provided with a main body portion arranged straddling frame 111 in a left-right direction, and support section 113 protruding to the inside from the main body portion in the front-rear direction of frame 111. Two support sections 113 are provided in parallel on the left and right for each holder 112. As shown in the enlarged box in the top right of FIG. 4, support section 113 includes opening section 114 through which shaft member 35 of squeegee 30 can pass through in the front-rear direction. Also, support section 113 includes engaging section 115 that engages with flange section 36 of squeegee 30 to fix squeegee 30. Engaging member 115 is a recess formed in the edge of the opening of support section 113 into which a portion of the lower surface of flange section 36 fits. When flange section 36 is fitted into engaging section 115, relative movement of squeegee 30 in the XY direction with respect to squeegee conveyance jig 110 is regulated by the weight of squeegee 30 itself. Also, squeegee 30, at a position raised up such that flange section 36 is separated from engaging section 115 (referred to as a removal position), is released from the regulating of movement in the XY direction, and is able to be removed from opening section 114. Barcode 116 is identification information for identifying the squeegee 30 attached to squeegee conveyance jig 110, and is read in advance by an operator, for example.

Conveyance rod 38 is provided in printing head 21 (FIG. 2) in a manner capable of being raised and lowered by a motor, which is not shown. Conveyance rod 38, by being moved to the front or rear by printing moving section 22 in a state protruding below squeegee 30, pushes and conveys screen mask 55 and each conveyance jig loaded on conveyance rails 53. By this, conveyance rod 38 is able to load and unload screen mask 55 and each conveyance jig from accommodation apparatus 100 to printing apparatus 10.

Supply section 40 is for supplying solder housed in cartridge 49 onto screen mask 55. Supply section 40 is provided with supply head 41 and supply moving section 46. Supply head 41 is for positioning and holding cartridge 49 and ejecting solder. Supply moving section 46 is for moving supply head 41 in the X-axis direction (left-right direction). As shown in FIG. 3, supply head 41 is provided with air supply section 42, clamp section 43, and rotation motor 44. Also, as shown in FIG. 6, supply head 41 is provided with rear plate section 41*a* disposed on supply moving section 46, and fixing member 41*b* formed protruding to the front from the top end of rear plate section 41*a*. Supply head 41 moves between an ejecting position at which solder is ejected onto screen mask 55, and holder 122 of cartridge conveyance jig 120 on which is provided an exchange-use cartridge 49. Air supply section 42 is connected to cartridge 49 and is for supplying air to cartridge 49 in order to eject solder from cartridge 49. Air supply section 42 is round and is inserted into connecting section 49*d* that is a hole formed in cartridge 49. Air supply section 42 also acts as a cartridge 49 positioning section for fixing the position of cartridge 49 inserted into connecting section 49*d*. Air supply section 42 includes an opening underneath and is provided on a lower surface of fixing member 41*b*. Air supply section 42 ejects air from an opening via a pipe, which is not shown.

Clamp section 43 is a member for fixing cartridge 49. Clamp section 43 is rotatably supported on a lower side of rear plate section 41*a*, and moves (here, rotates) to and from a fixed position at which cartridge 49 is fixed and a released position at which the fixing of cartridge 49 is released, the movement being performed via driving power from rotation motor 44. The released position is a position at which clamp section 43 is in a state hanging down in the same direction in which rear plate section 41*a* is formed. The fixed position is a position at which clamp section 43 is in a horizontal state perpendicular to the direction in which rear plate section 41*a* is formed. If clamp section 43 is moved to the fixed position in a state with air supply section 42 connected to connecting section 49*d* of cartridge 49, clamp section 43 supports and fixes cartridge 49 from below. Clamp section 43 is formed in a round shape with a hole in the middle, and the bottom section of cartridge 49 fits into the hole.

Supply moving section 46 is provided on the front surface of printing head 23. Thus, supply head 41 is moved in the Y-axis direction by printing moving section 24, and is moved in the X-axis direction by supply moving section 46. Supply moving section 46 is provided with guide 46*a*, ball screw 46*b*, and driving motor 48. By driving motor 48 rotating ball screw 46*b*, supply head 41 is moved in the left and right directions along guide 46*a*.

Cartridge 49 includes cylindrical main body section 49*a*, flange sections 49*b* provided on the upper side and lower side of main body section 49*a* and formed with a diameter larger than main body section 49*a*, and connecting section 49*d* formed at a central position on the upper side of flange section 49*b*. A nozzle, not shown, for ejecting solder to the outside is formed at a central portion of flange section 49 on the lower side of cartridge 49. Connecting section 49*d* is a hole into which air supply section 42 is inserted to be connected. With cartridge 49, when air is supplied from air supply section 42 to connecting section 49*d*, a pressure member, not shown, inside main body section 49*a* is pushed such that solder inside is ejected from the nozzle.

FIG. 5 also shows cartridge conveyance jig 120 used in automatic exchange of cartridge 49 by printing apparatus 10. Cartridge conveyance jig 120 is provided with frame 121, multiple holders 122 to which cartridge can be attached, and barcode 126. Multiple holders 122 (five in FIG. 5) are arranged in the X direction, with each being attached to the rear of frame 121. As shown in FIG. 6, holder 122 includes support section 123 including opening section 124 through which main body section 49*a* of cartridge 49 can pass through, and engaging section 125 that engages with flange section 49*b* on the upper side of cartridge 49 formed on support section 123 so as to fix cartridge 59. Support section 123 is a C-shaped plate member. Engaging member 125 is a recess formed in the edge of the opening of support section 123 into which a portion of the lower surface of the upper side of flange section 49*b* fits. When flange section 49*b* is fitted into engaging section 125, relative movement of cartridge 49 in the XY direction with respect to cartridge conveyance jig 120 is regulated by the weight of cartridge 49 itself. Also, cartridge 49, at a position raised up such that flange section 49*b* is separated from engaging section 125 (referred to as a removal position), is released from the regulating of movement in the XY direction, and is able to be removed from opening section 124. Note that, when the above clamp section 43 of supply head 41 is rotated to the fixed position, clamp section 43 raises cartridge 49 attached to holder 122, and cartridge 49 is positioned at the removal position from holder 122. That is, operation for fixing cartridge 49 by clamp section 43 also acts as operation for releasing the movement regulating of cartridge 49 from holder 122. Barcode 126 is provided near the rear end on the right side of cartridge conveyance jig 120, more specifically, at the right side of the holder 122 further to the right. Barcode 116 is identification information for identifying the cartridge 49 attached to cartridge conveyance jig 120, and is read in advance by an operator, for example.

Mask work section 50 is a unit for fixing and holding screen mask 55 and is provided between print process section 20 and board fixing section 60 in a vertical direction as shown in FIG. 2. As shown in FIG. 3, mask work section 50 is provided with mask fixing section 51, position adjusting section 52, and conveyance rail 53. Mask fixing section 51 is for positioning screen mask 55 and holding and fixing it in a horizontal posture. Position adjusting section 52 is for adjusting the position of mask fixing section 51 in the XY direction such that hole pattern 58 of screen mask 55 is arranged at a correct position with respect to the board S fixed by board fixing section 60. Conveyance rail 53 is a pair of left and right rails extending in the front-rear direction, and acts to guide screen mask 55 and each conveyance jig pushed by conveyance rod 38 as they move in the front-rear direction. Screen mask 55 is provided with mask main body 56 in which hole pattern 58 of a specified wiring pattern or the like is formed, and frame 57 that supports mask main body 56 at a specified tension. Mask main body 56 is, for example, a thin metal plate. An identification section (for example, a mark) for position identification is formed on the lower surface of screen mask 55. Barcode 57*a* (FIG. 5) representing identification information of screen mask 55 is provided near the rear end on the right side of screen mask 55. The barcode, for example, is read in advance by an operator.

Board fixing section 60 is provided below mask work section 50, and is a unit for loading board S, positioning and supporting the loaded board S, and moving the board S towards and away from screen mask 55. As shown in FIGS. 1 to 3, board fixing section 60 is provided with board conveyance conveyor 61, board guide 62, board guide moving section 63 (refer to FIG. 3), support table raising and lowering section 65, fixing section raising and lowering section 66, support table 67, and board support member 70. A board conveyance conveyor 61 is provided for each of the pair of side frames 60*b*, and conveys board S in the X direction. Board guides 62 are plate members provided on the upper surfaces of the pair of side frames 60*b*. Board guide moving section 63 is a mechanism for moving the pair of side frames 60*b* in a front-rear direction towards and away from each other. By this, board guide 62 is also moved in a front-rear direction, and board S is fixed by being sandwiched in a state with an upper surface of board S and an upper surface of board guide 62 being level. Support table raising and lowering section 65 is a mechanism for raising and lowering support table 67 with respect to main body 60*a* of board fixing section 60. Fixing section raising and lowering section 66 is a mechanism for raising and lowering the entire board fixing section 60 with respect to the main body of printing apparatus 10. Support table 67 is a member on which board support member 70 can be arranged. Note that, board fixing section 60 is provided with a fixing section and position adjusting section, which are not shown, that perform fixing and positioning of board support member 70 on support table 67.

Board support member 70 is arranged on support table 67 and is connected to a pressure reducing device, not shown, via a pipe and holds and fixes board S from below using suction due to negative pressure. As shown in FIG. 7, board support member 70 is provided with main body section 70*a*, pair of cylindrical protruding sections 71 and 71 arranged to protrude from the left and right of main body section 70*a*, pair of protruding sections 72 and 72 arranged to the front of protruding sections 71, and multiple suction openings 73 that open on an upper surface of main body section 70*a*. The multiple protruding sections 71 and 72 function as engaging sections that engage with first to fourth protrusion holding sections 132 to 135 of support member conveyance jig 130 shown in FIG. 7. Also, identification section 75 (for example, a mark) for position identification and barcode 76 for type identification of board support member 70 are formed on an upper surface of main body section 70*a*. Board support member 70 is exchanged in accordance with the board S.

FIG. 7 also shows support member conveyance jig 130 used in automatic exchange of board support member 70 by printing apparatus 10. Support member conveyance jig 130 is provided with frame 131, first to fourth protrusion holding sections 132 to 135 provided inside frame 131, and barcode 136 provided near the rear end at the right side of frame 131. First to fourth protrusion holding sections 132 to 135 are provided in order from the front side to the rear side. Each of the first to fourth protrusion holding sections 132 to 135 is provided in pairs on the left and right, and is provided on the end of a leg section that extends down from frame 131. One board support member 70 is able to be attached to support member conveyance jig 130 using first and second protrusion holding sections 132 and 133, and one board support member 70 is able to be attached to support member conveyance jig 130 using third and fourth protrusion holding sections 134 and 135. A recess slightly larger than the outer diameter of protruding section 71 and protruding section 72 of board support member 70 is formed on an upper surface of first to fourth protrusion holding sections 132 to 135. By loading protruding sections 71 and 72 in these recesses, board support conveyance jig 130 is able to convey board support member 70 while fixing relative movement of board support member 70 in the front-rear direction. Barcode 136 is identification information for identifying the board support member 70 attached to support member conveyance jig 130, and is read in advance by an operator, for example.

Cleaning section 80 is a unit for performing cleaning processing for cleaning a lower surface of screen mask 55 and is provided between mask work section 50 and board fixing section 60 in a vertical direction as shown in FIG. 2. As shown in FIGS. 8 and 9, cleaning section 80 is provided with exchange module 81 including cleaning member 82 capable of exchanging cleaning member 82 to and from accommodation apparatus 100, loading member 84 on which exchange module 81 is loaded, support member 86 that supports exchange module 81 and loading member 84, and cleaning moving section 87 that moves exchange module 81 and loading member 84. Note that, FIG. 8 also shows cleaning member conveyance jig 140 used in automatic exchange of exchange module 81 by printing apparatus 10. Also, cleaning moving section 87 is able to switch to and from a protruding state in which exchange module 81 and loading member 84 are protruding forward, and a non-protruding state in which they are not protruding. FIG. 8 shows the protruding state and FIG. 9 shows the non-protruding state.

Exchange module 81 is provided with first roller 81*a*, second roller 81*b*, cleaning member 82, and attachment member 83. Cleaning member 82 is a member for cleaning screen mask 55 and in the present embodiment is a wiping sheet that cleans screen mask 55 by being wiped against it.

Cleaning member 82 is wound on first roller 81*a*. Second roller 81*b* is arranged forward to first roller 81*a* and takes up cleaning member 82 from first roller 81*a*. The portion of cleaning member 82 between first roller 81*a* and second roller 81*b* is used to clean screen mask 55.

Attachment member 83 is for attaching first and second rollers 81*a* and 81*b* and cleaning member 82. Attachment member 83 includes case body 83*a* that is a box-shaped member open at the top and bottom. Two pairs, that is, a total of four, shaft receivers 83*b* are provided opposite on the left and right inside sides of case body 83*a*. The shaft ends of first and second rollers 81*a* and 81*b* can be inserted into the pairs of shaft receivers 83*b* such that shaft receivers 83*b* rotatably support first and second rollers 81*a* and 81*b*. Shaft receiver 83*b* on the front right, which is not shown, is coaxially connected to gear 83*c* provided on the outside of case body 83*a*, such that second roller 81*b* and gear 83*c* rotate together. Gear 83*c* is arranged so as to engage with gear 86*b* of winding motor 86*a* in a non-protruding state, such that second roller 81*b* rotates to take up cleaning member 82 due to the driving force from winding motor 86*a*. Also, case body 83*a* includes protruding sections 83*d* that each protrude from attachment members 83 in the left and right directions. In the present embodiment, one protruding section 83*d* is provided on the right side of case body 83*a*, and two protruding sections 83*d* are provided on the left side of case body 83*a*. The multiple protruding sections 83*d* act as engaging sections that engage with protrusion holding sections 142 of cleaning member conveyance jig 140 shown in FIG. 8. Receiving members 83*e* are provided on the left and rights ends on the front surface of case body 83*a*. Receiving member 83*e* includes a recess open towards the outside on the right or left, and is configured to engage with lock member 86*d* of lock mechanism 86*c* in a non-protruding state. Opening sections 83*f* are formed on the left and right sides of case body 83*a* and engaging shafts 83*g* that extend in the Y direction are arranged inside opening sections 83*f*. Engaging shafts 83*g* are configured to engage with claw members 84*c* of loading members 84 (refer to the enlarged portion at the top right of FIG. 8).

Loading member 84 is configured as a plate member on which exchange module 81 is loaded and that supports exchange module 81 from below. Loading member 84 and attachment member 83 act as a cleaning head and are moved to the front and rear by cleaning moving section 87. Arranged on the upper surface of loading member 84 are contacting member 84*a*, raising and lowering device 84*b*, claw member 84*c*, and connecting section 84*d*. Contacting member 84*a* supports cleaning member 82 from below. Raising and lowering device 84*b* is configured from, for example, an air cylinder, and raises and lower contacting member 84*a* while supporting it from below. In a state with contacting member 84*a* raised by raising and lowering device 84*b*, by contacting member 84*a* raising up cleaning member 82, the upper surface of cleaning member 82 contacts the lower surface of screen mask 55. In this state, by cleaning moving section 87 moving loading member 84, cleaning section 80 performs cleaning operation by cleaning member 82 wiping off solder from the lower surface of screen mask 55. Claw member 84*c* is for preventing exchange module 81 falling from loading member 84 when loading member 84 is moving in the Y direction, a one claw member 84*c* each is provided on the left and right of loading member 84. Claw member 84*c* is roughly rectangular block with a lengthwise direction in the vertical direction. Claw member 84*c* includes an inclined surface on the upper end on the inside in the left-right direction (inside of attachment member 83), and a recess that engages with engaging shaft 83*g* of attachment member 83 is formed on the lower surface of the inclined surface. Claw member 84*c* is provided near the lower end and is rotatably supported around a rotation shaft along the Y direction, and is biased by a biasing member such as a spring, which is not shown, such that the upper end of claw member 84*c* is rotated to the inside in the left-right direction. Thus, when exchange module 81 is lowered from above loading member 84, engaging shaft 83*g* of attachment member 83 of exchange module 81 is guided by the inclined surface of claw member 84*c*, engages with the recess of claw member 84*c*, such that relative movement in the Y direction between attachment member 83 and loading member 84 is regulated. Note that, the biasing force of the biasing member biasing claw member 84*c* is adjusted such that, when exchange module 81 is attempted to be moved up from loading member 84, the engagement of engaging shaft 83*g* and claw member 84*c* is released. Connecting section 84*d* is for connecting to connecting section 89*b* of loading member moving mechanism 89, and is arranged on the rear side of loading member 84.

As shown in FIG. 1, support member 86 is a plate supported by guide rails 88*b* on the left and right edges. Thus, support member 86 supports loading member 84 in a horizontal direction from the left and right. Winding motor 86*a* and lock mechanism 86*c* are arranged on support member 86. Winding motor 86*a* is arranged on support member 86 on the right side of attachment member 83, and is configured to rotate gear 83*c* and second roller 81*b* via gear 86*b*. Cleaning section 80, for example, by winding motor 86*a* rotating second roller 81*b* for a specified time after cleaning processing, performs sheet feeding processing of taking up the portion of cleaning member 82 used in cleaning, that is, the portion with solder on, onto second roller 81*b*. Lock mechanism 86*c*, for example, is configured from an air cylinder, and is a mechanism for using the cylinder to make lock member 86 protrude in the X direction. One lock mechanism 86*c* each is arranged on support member 86 on the left and right sides of attachment member 83. As shown in FIG. 9, when lock mechanism 86*c* makes lock member 86*d* protrude to the attachment member 83 side with exchange module 81 and loading member 84 in a non-protruding state, lock member 86*d* is inserted into and engages with the recess of receiving member 83*e* of attachment member 83. Accordingly, relative movement in the Y direction with respect to support member 86 of exchange module 81 and loading member 84 is regulated, and they are fixed in the non-protruding state. On the other hand, as shown in FIG. 8, in a state in which lock mechanism 86*c* is not making lock member 86*d* protrude, it is possible to switch exchange module 81 and loading module 84 to and from a protruding state and a non-protruding state using loading member moving mechanism 89.

Cleaning moving section 87 is provided with support member moving mechanism 88 and loading member moving mechanism 89. As shown in FIG. 1, support member moving mechanism 88 includes Y-axis slider 88*a* and pair of left and right guide rails 88*b* extending in the front-rear direction. Y-axis slider 88*a* is arranged on support member 86 and support member 86 is moved in the Y direction by Y-axis slider 88*a* being moved along guide rails 88*b*. Support member moving mechanism 88 also moves exchange module 81 and loading member 84 in the Y direction by moving support member 86 in the Y direction. As shown in FIGS. 8 and 9, loading member moving mechanism 89 is provided with drive source 89*a* configured as, for example, an air cylinder, and connecting section 89*b* connected to connecting section 84*d* of loading member 84 and arranged at the end of the cylinder rod of drive source 89*a*. Also, loading member moving mechanism 89 is provided with expansion rail 89*c* that is arranged on support member 86 and provided with multiple rails that slide in the Y direction. When driving power in the Y direction is applied by drive source 89*a* via connecting section 89*b* and connecting section 84*d*, expansion rails 89*c* are extended or retracted, such that loading member 84 is moved in the Y direction relative to support member 86. Thus, loading member moving mechanism 89 is able to switch exchange module 81 and loading member 84 to and from a protruding state protruding relatively with respect to support member 86 (FIG. 8), and a non-protruding state not protruding relatively with respect to support member 86 (FIG. 9). Cleaning moving section 87, by support member moving mechanism 88 and loading member moving mechanism 89, is able to move cleaning member 82 to and from a cleaning position at which cleaning of screen mask 55 is performed by cleaning member 82, and an exchange position at which cleaning member 82 is exchanged with cleaning member conveyance jig 140. Note that, the cleaning position, for example, is directly under screen mask 55 fixed by mask fixing section 51. The exchange position is a position at which transfer at exchange module 81 is performed between, for example, cleaning member conveyance jig 140 and cleaning section 80. Also, cleaning moving section 87 performs loading of cleaning member 82 and exchange module 81 including cleaning member 82.

Cleaning member conveyance jig 140 shown in FIG. 8 acts a holder to which exchange module 81 is attached. Cleaning member conveyance jig 140 is provided with frame 141 that is open on the rear side, protrusion holding sections 142 provided on the left and right sides on the inside of frame 141, and barcode 146 provided near the rear end at the right side of frame 141. A quantity of protrusion holding sections 142 is provided corresponding to the protruding sections 83 of attachment member 83 (in this case, three). More specifically, there is one protrusion holding section 142 on the right, and two protrusion holding sections 142 on the left. Protrusion holding section 142 has a recess formed in an upper surface thereof, and protrusion holding section 142 engages with protruding section 83*d* loaded in this recess to support protruding section 83*d* from below. By protruding section 83*d* engaging with this recess, relative movement of exchange module 81 in the front-rear direction of cleaning member conveyance jig 140 is fixed while allowing conveyance of exchange module 81. Barcode 146 is identification information for identifying the cleaning member 82 attached to cleaning member conveyance jig 140, and is read in advance by an operator, for example.

Reading section 97 is for reading information related to at least one type of the exchangeable members 13 and in the present embodiment is configured from a barcode reader. As shown in FIG. 1, reading section 97 is provided on the right side inside printing apparatus 10, and the left direction is the reading direction. Reading section 97 is arranged at a height the same as the height at which screen mask 55 is loaded and unloaded (loading height and unloading height), such that barcode 57*a* (FIG. 5) provided on the right side of screen mask 55 can be read. Also, reading section 97 is able to read barcodes 116, 126, 136, and 146 provided respectively on conveyance jigs 110, 120, 130, and 140, so long as they are conveyed at the same height.

Accommodation apparatus 100 is arranged at the front of printing apparatus 10, and accommodates at least one type (here, five types) of exchangeable members 13, and performs loading and unloading of at least one type (here, five types) of exchangeable members 13 to and from printing apparatus 10. Accommodation apparatus 100 is provided with housing 101, accommodation section 102, conveyance conveyor 104, conveyor raising and lowering section 105, and accommodation control section 106. Housing 101 is roughly a cuboid box and includes accommodation section 102 on the inside. Moving sections such as casters are provided on the lower surface of housing 101 such that, for example, accommodation apparatus 100 can be moved by an operator. Accommodation section 102 is a box capable of accommodating exchangeable members 13 and conveyance jigs, and is provided with multiple conveyance conveyors 104 inside thereof. Conveyance conveyors 104 are provided at multiple levels in the vertical direction, and in the present embodiment, as shown in FIG. 2, there are nine conveyance conveyors 104*a* to 104*i* arranged in order from a first to a ninth. Each of the first to ninth conveyance conveyors 104*a* to 104*i* is configured with a pair of left and right belt conveyors, so as to convey a loaded item in the front-rear direction. Note that, for ease of understanding, only four levels of conveyance conveyors 104 are shown. Accommodation section 102 is configured to be able to load at least one exchangeable member 13 in each of the first to ninth conveyance conveyors 104*a* to 104*i*. Also, accommodation section 102 includes multiple levels of accommodation regions 103 in the vertical direction divided according to first to ninth conveyance conveyors 104*a* to 104*i*. Accommodation region 103 includes first accommodation region 103*a* as a region above first conveyance conveyor 104*a*, and similarly includes second to ninth accommodation regions 103*b* to 103*i* respectively above second to ninth conveyance conveyors 104*b* to 104*i*. Note that, it is not essential that accommodation region 103 is inside accommodation section 102. For example, cartridge conveyance jig 120 loaded on first conveyance conveyor 104*a* shown in FIG. 2 has a portion protruding to the rear from accommodation section 102, but the region occupied by this protruding portion is also included in first accommodation region 103*a*. Accommodation section 102 is open at the front and rear. Thus, an operator is able to insert exchangeable members 13 into accommodation section 102 from the front, and accommodation apparatus 100 is able to load and unload exchangeable members 13 to and from printing apparatus 10 via the rear of accommodation section 102. Conveyor raising and lowering section 105 is configured to raise and lower accommodation section in a vertical direction and is provided with, for example, a guide, a ball screw, and a driving motor, which are not shown. By conveyor raising and lowering section 105 raising or lowering accommodation section 102, conveyance conveyor 104 is raised or lowered.

In the present embodiment, cartridge conveyance jig 120 is loaded on first conveyance conveyor 104*a*, squeegee conveyance jig 110 is loaded on second and third conveyance conveyors 104*b* and 104*c*, cleaning member conveyance jig 140 is loaded on fourth and fifth conveyance conveyors 104*d* and 104*e*, screen mask 55 is loaded on sixth and seventh conveyance conveyors 104*f* and 104*g*, and support member conveyance jig 130 is loaded on eighth and ninth conveyance conveyor jigs 104*h* and 104*i*. The gap between adjacent conveyance conveyors 104 in the vertical direction is adjusted in accordance with the height of the conveyance jig or the exchangeable member 13 attached to the conveyance jig loaded on each conveyance conveyor 104. Note that, conveyance jigs 110 to 140 and screen mask 55 have a predetermined width in the left-right direction that enables them to be loaded on the multiple conveyance conveyors 104, for example, they may all have substantially the same width in the left-right direction.

Accommodation control section 106 is configured from a microprocessor based around a CPU, and is provided with ROM that memorizes a processing program, RAM used as working memory, an HDD that memorizes various data, and so on. Accommodation control section 106 performs overall control of accommodation apparatus 100.

Figure 10:
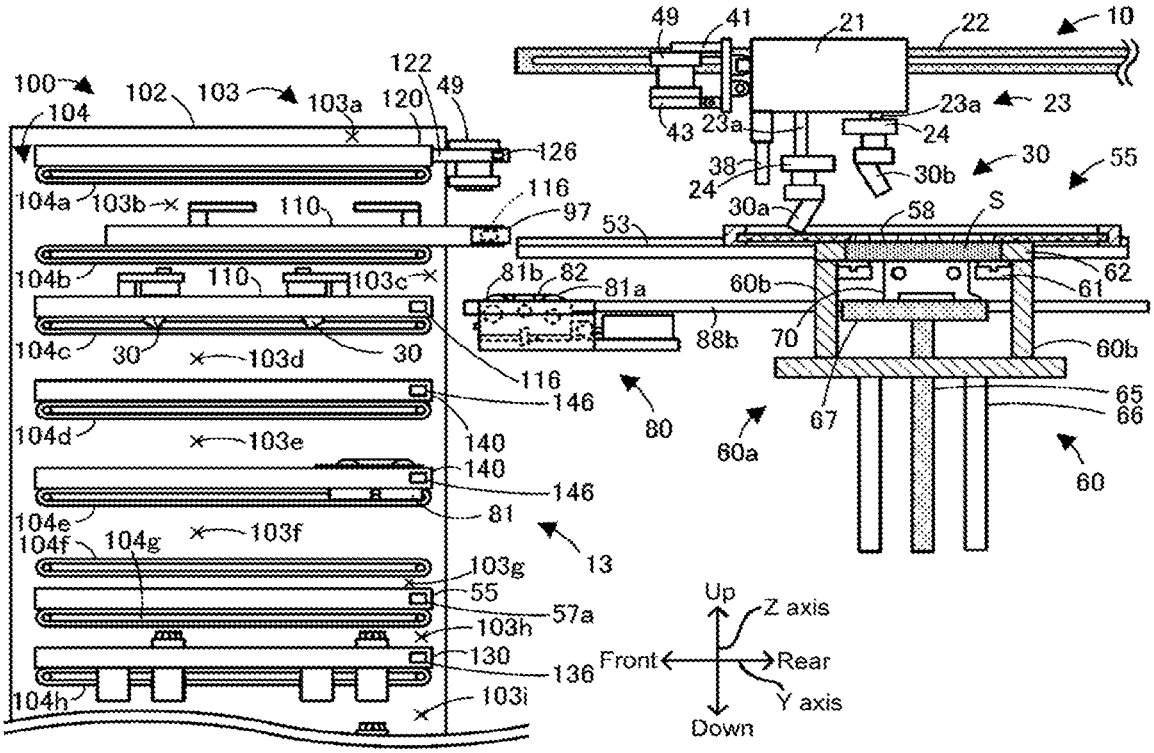
FIG. 10 illustrates a printing process and a reading process being performed in parallel.

Operation of the above printing system 1 is described next. First, descriptions are given with regard to printing processing performed by printing apparatus 10, and reading processing for reading identification information of exchangeable members 13 accommodated in accommodation apparatus 100 that is performed in parallel with printing processing. FIG. 10 illustrates a printing process and a reading process being performed in parallel.

First, printing processing is described. The printing processing routine for performing printing processing is memorized on the HDD of printing control section 11, and is performed by printing control section 11 after instructions to perform printing processing are entered by an operator via display operation section 98, or is performed by printing control section 11 after instructions to perform printing processing are issued by management PC 150. When the printing processing routine is started, printing control section 11, first, as shown in FIG. 10, performs board conveyance and fixing processing to fix board S using board fixing section 60 such that board S contacts screen mask 55. Specifically, printing control section 11, first, drives board conveyance conveyor 61 to convey board S to board fixing section 60, and fixes board S by sandwiching it between board guides 62. Further, printing control section 11 adjusts the position of screen mask 55 as necessary using mask work section 50 and aligns the positions of hole pattern 58 and board S. Next, printing control section 11 raises support table 67 such that the upper surface of board support member 70 contacts the lower surface of board S, and fixes board S against board supporting member 70 via suction applied from negative pressure from a pressure reducing device. Further, printing control section 11 raises board fixing section 60 such that the upper surface of board S contacts the lower surface of screen mask 55. Upon board conveyance and fixing processing being performed, printing control section 11 performs solder supply processing. Specifically, printing control section 11 moves supply head 41 above screen mask 55, supplies air from air supply section 42, so as to emit solder from cartridge 49 onto screen mask 55. Upon solder supply processing being performed, printing control section 11 performs squeegee moving processing. Specifically, printing control section 11 moves printing head 21, lowers squeegee 30 (first squeegee 30*a* in FIG. 10) such that squeegee 30 contacts the upper surface of screen mask 55 and moves squeegee 30 in the front-rear direction such that solder is printed onto the board S. Printing control section 11 performs at least one of processing to move first squeegee 30*a* in the rear direction on screen mask 55, and processing to move second squeegee 30*b* in the front direction. In this manner, printing control section 11 performs printing processing that includes board conveyance and fixing processing, solder supply processing, and squeegee moving processing, so as to perform printing onto board S. Printing control section 11 repeatedly performs printing processing until production processing is complete. Note that, printing processing may include the above cleaning processing and sheet feeding processing. Printing control section 11, for example, performs cleaning processing and sheet feeding processing to clean the underside of screen mask 55 at a specified timing such as periodically at a specified time interval, or every time printing processing on multiple boards S has been performed a specified quantity of times.

While printing apparatus 10 is performing printing processing, an operator may, for a case in which it is necessary to exchange at least one of the exchangeable members 13 such as due to changeover, accommodate an exchange-use exchangeable member 13 in advance in accommodation apparatus 100. For example, in a case in which it is necessary to exchange all of the five types of exchangeable members 13 during the next changeover, an operator puts the appropriate conveyance jigs and exchangeable members 13 loaded on conveyance jigs into accommodation apparatus 100 in advance as shown in FIG. 2. Specifically, the operator, as shown in FIG. 2, loads cartridge conveyance jig 120 with exchange-use cartridge 49 attached to holder 122 into first accommodation region 103*a*. Here, the operator, as shown in FIG. 5, leaves at least one of the multiple holders 122 of cartridge conveyance jig 120 empty. The operator loads an empty squeegee conveyance jig 110 in second accommodation region 103*b*, and loads a squeegee conveyance jig 110 with two exchange-use squeegees 30 attached to third accommodation region 103*c*. The operator loads an empty cleaning member conveyance jig 140 to fourth accommodation region 103*d*, and loads a cleaning member conveyance jig 140 with an exchange-use exchange module 81 attached to fifth accommodation region 103*e*. The operator leaves sixth accommodation region 103*f* empty for unloading from printing apparatus 10 of the screen mask 55 currently in use, and loads an exchange-use screen mask 55 in seventh accommodation region 103*g*. The operator loads an empty support member conveyance jig 130 in eighth accommodation region 103*h*, and loads a support member conveyance jig 130 with an exchange-use board support member 70 attached to ninth accommodation region 103*i*. In this manner, the operator, while printing apparatus 10 is performing printing processing and it is not time to exchange an exchangeable member 13 such as due to changeover, may load in advance exchange-use exchangeable members 13 to accommodation apparatus 100. Accordingly, the operator is able to perform work for exchange-use exchangeable members 13 during a period in which their workload is light.

Note that, the operator may attach in advance to each conveyance jig a barcode indicating the identification information of the exchangeable member 13 attached to that conveyance jig. For example, the operator, may include information representing the type of the cartridge 49 attached to a cartridge conveyance jig 120 in the identification information included in the barcode of that cartridge conveyance jig 120. Similarly, the operator may include information representing the type of the screen mask 55 in the identification information included in the barcode 57*a* of that screen mask 55. Accordingly, printing control section 11, by reading the barcode of each conveyance jig and screen mask 55 using reading section 97, is able to identify which of the types of exchangeable members 13 a member for which the barcode is being read is. Also, printing control section 11, for example, is able to perform detailed identification within a given type of exchangeable member 13 such as identifying which of multiple types of cartridges 49 is the cartridge 49 attached to a cartridge conveyance jig 120. Note that, a barcode may include information representing a state of each conveyance jig (such as whether a holder is empty). For example, information of which of the multiple holders 122 of a cartridge conveyance jig 120 a cartridge 49 is attached to (which of the holders 122 is empty) may be included on the barcode 126 for a cartridge conveyance jig 120.

Reading processing is described next. The reading processing routine for performing reading processing is memorized on the HDD of printing control section 11, and is performed, for example, at a specified time interval, or after an instruction to perform reading processing is entered by an operator. When the reading processing routine is started, printing control section 11 outputs an instruction to accommodation control section 106 of accommodation apparatus 100 to sequentially move an empty conveyance jig or an exchangeable member 13 accommodated in accommodation section 102 to a position at which reading is possible by reading section 97. Accommodation control section 106 that has received this instruction, first, uses conveyor raising and lowering section 105 to raise or lower accommodation section 102 such that cartridge conveyance jig 120 on first conveyance conveyor 104*a* is positioned at the same height as reading section 97. Further, accommodation control section 106, as necessary, uses first conveyance conveyor 104*a* to move cartridge conveyance jig 120 in the Y direction, such that barcode 126 is moved to a position where reading is possible by reading section 97, and then cartridge conveyance jig 120 is returned to its original position. Here, printing control section 11 uses reading section 97 to read barcode 126 and memorizes the acquired information on the HDD. Accommodation control section 106 performs similar processing sequentially for second conveyance conveyor 104*b* to ninth conveyance conveyor 104*i*. FIG. 10 shows accommodation apparatus 100 in a state with squeegee conveyance jig 110 accommodated in second accommodation region 103*b* moved to a position at which reading by reading section 97 is possible. In this manner, with reading processing, printing control section 11 performs movement such that reading by reading section 97 is possible by making accommodation apparatus 100 perform at least one of conveyance or raising and lowering of exchangeable member 13. According to such reading processing, printing control section 11 acquires and memorizes information required for exchange processing, which is described later, such as information of the exchangeable members 13 accommodated in each of the accommodation regions 103 of accommodation apparatus 100, and information of which types of conveyance jigs are accommodated in each of the accommodation regions 103. Also, printing control section 11 is able to identify empty accommodation regions 103 that do not accommodate a conveyance jig (in FIG. 10, this is sixth accommodation region 103*f*) by, for example, detecting that a specified time has elapsed without reading section 97 having read information despite conveyance having been performed by conveyance conveyor 104. Note that, as shown in FIG. 10, reading section 97 is arranged at the front side of printing apparatus 10. Thus, even if an exchangeable member 13 is moved from the accommodation apparatus 100 in front to the reading position of reading section 97, there is no impediment to operation of print process section 20, supply section 40, mask work section 50, board fixing section 60, and cleaning section 80 during the above-described printing processing. Accordingly, printing control section 11 can perform reading processing in parallel with printing processing. By this, printing control section 11 is able to acquire information of exchangeable members 13 and conveyance jigs accommodated in accommodation apparatus 100 without stopping printing processing.

Note that, with regard to operation on the accommodation apparatus 100 side during reading processing, an operation routine for during reading processing may be memorized in advance on the memory section of accommodation control section 106, and printing control section 11 may issue just a starting instruction for the operation routine. Alternatively, printing control section 11 may sequentially output an individual operation command for conveyor raising and lowering section 105 and conveyance conveyor 104 to accommodation control section 106.

Figure 11:
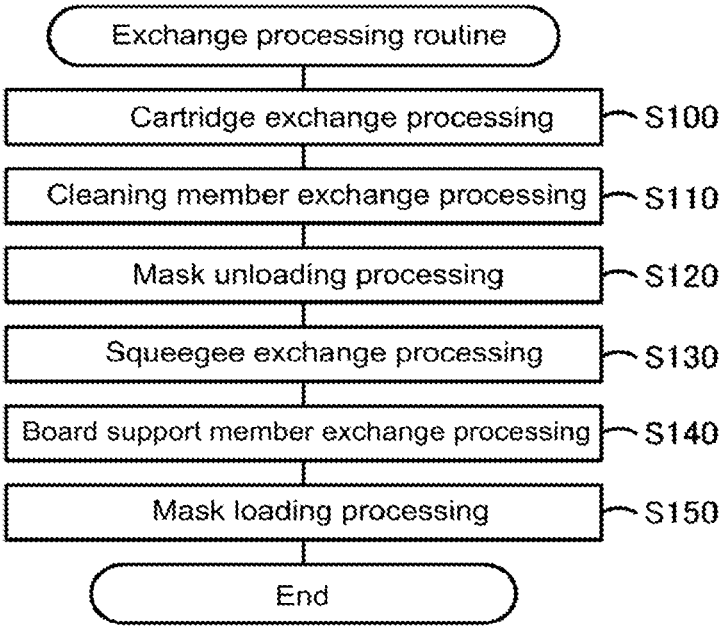
FIG. 11 is a flowchart showing an example of an exchange processing routine.

Described next is exchange processing for performing automatic exchange of exchangeable member 13. FIG. 11 is a flowchart showing an example of an exchange processing routine. The exchanging processing routine is memorized on the HDD of printing control section 11. Printing control section 11 determines whether exchange processing is required by, for example, each time printing processing is completed, determining whether at least one of the exchangeable members 13 required for the next printing processing is different to those required for the current printing processing based on information related to printing processing acquired from management PC 150. Further, printing control section 11, upon determining that exchange processing is required, starts the exchange processing routine. Note that, printing control section 11 performs the exchange processing routine while referencing as appropriate the information acquired during the reading processing described above.

Printing control section 11, upon starting the exchange processing routine, performs at least one of the following sets of processing as required: cartridge exchange processing (step S100); cleaning member exchange processing (step S110); mask unloading processing (step S120); squeegee exchange processing (step S130); board support member exchange processing (step S140); and mask loading processing (step S150). Note that, because cartridge 49 and cleaning member 82 are consumables, not limited to cases in which each type is changed, in cases in which exchange processing needs to be performed, along with performing at least one of cartridge exchange processing and cleaning member exchange processing, replenishment of consumables may be performed without changing the type of the consumable. For example, when it is necessary to exchange at least one of squeegee 30, screen mask 55, or board support member 70, at least one of cartridge 49 and cleaning member 82 may be exchanged at the same time. Also, in the present embodiment, when performing exchange of screen mask 55, squeegee 30, or board support member 70, the conveyance jig is moved using conveyance rails 53. Thus, when it is necessary to perform at least one of squeegee exchange processing and board support member exchange processing, mask unloading processing is performed that processing such that screen mask 55 is retracted from conveyance rails 53, and then mask loading processing is performed. Also, processing including mask unloading processing and mask loading processing corresponds to mask exchange processing. Note that, when it is not necessary to exchange screen mask 55, during mask loading processing, the screen mask 55 unloaded during mask unloading processing is loaded. Described below is the processing of steps S100 to S150 using an example when all five types of exchangeable members 13 are exchanged.

Figure 12:
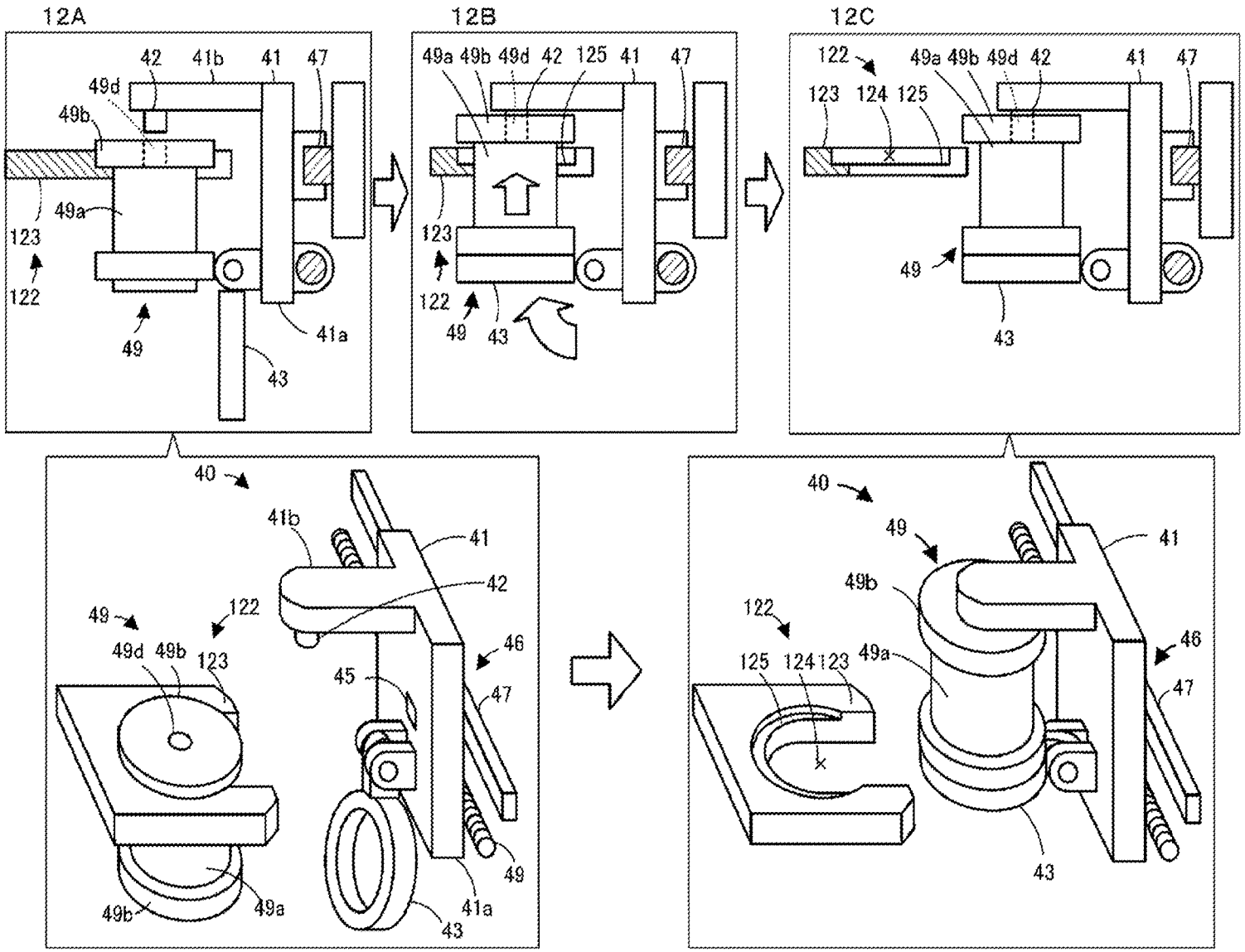
FIG. 12 illustrates operation of mounting cartridge 49 on supply head 41.

Described below is cartridge exchange processing of step S100. FIG. 12 illustrates operation of mounting cartridge 49 on supply head 41. Upon starting cartridge exchange processing, printing control section 11 performs cartridge unloading processing of unloading cartridge 49 attached to supply head 41, and cartridge loading processing of loading an exchange-use cartridge 49. With cartridge unloading processing, printing control section 11, first, operates conveyor raising and lowering section 105 such that the cartridge conveyance jig 120 on first conveyance conveyor 104*a* including an empty holder 102 is positioned at the height for unloading cartridge 49 (unloading height). The cartridge 49 unloading height is the height at which the cartridge 49 attached to supply head 41 can be attached to the empty holder 122, and is a height at which main body section 49*a* can be inserted into opening section 124. Next, printing control section 11 controls printing moving section 22 and supply moving section 46 such that the cartridge 49 attached to supply head 41 is moved to a transfer position at which that cartridge 49 can be attached to the empty holder 122 of cartridge conveyance jig 120. Continuing, printing control section 11 releases the attachment of the cartridge 49 by supply head 41 and attaches the cartridge 49 to the empty holder 122. During cartridge loading processing, printing control section 11, first, operates conveyor raising and lowering section 105 such that the cartridge conveyance jig 120 is positioned at the height for loading exchange-use cartridge 49 (loading height). Note that, in the present embodiment, the cartridge 49 loading height and unloading height are the same, so processing of operation of conveyor raising and lowering section 105 is omitted. Next, printing control section 11 moves supply head 41 to a position at which exchange-use cartridge 49 attached to holder 122 can be received by supply head 41, and then mounts exchange-use cartridge 49 on supply head 41. When the above cartridge unloading processing and cartridge loading processing have been performed, printing control section 11 ends cartridge exchange processing.

When cartridge 49 is attached to empty holder 122 during cartridge unloading processing, printing control section 11, first, moves clamp section 43 to a release position in a state with main body section 49*a* inserted into opening section 124 of holder 122 (an example of a transfer position). Upon doing this, in accordance with the rotation of clamp section 43, cartridge 49 is lowered, a cartridge 49 is supported by support member 123 with flange section 49*b* engaged in engaging section 125. When exchange-use cartridge 49 is mounted on supply head 41 during cartridge loading processing, printing control section 11, first, rotates clamp section 43 to the fixed position (12B) with connecting section 49*d* of cartridge 49 positioned directly below air supply section 42 (an example of a receiving position, FIG. 12A). When clamp section 43 has been positioned at the fixed position, clap section 43 pushes cartridge 49 up to release the engagement of clamp section 49*b* and engaging section 125 and cartridge 49 is positioned at the removal position. Here, air supply section 42 is inserted into connecting section 49*d*, cartridge 49 is positioned, and supply head 41 is able to supply air to main body section 49*a*. Then, printing control section 11 moves supply head 41 such that main body section 49*a* passes through opening section 124 (FIG. 12B).

Figure 13:
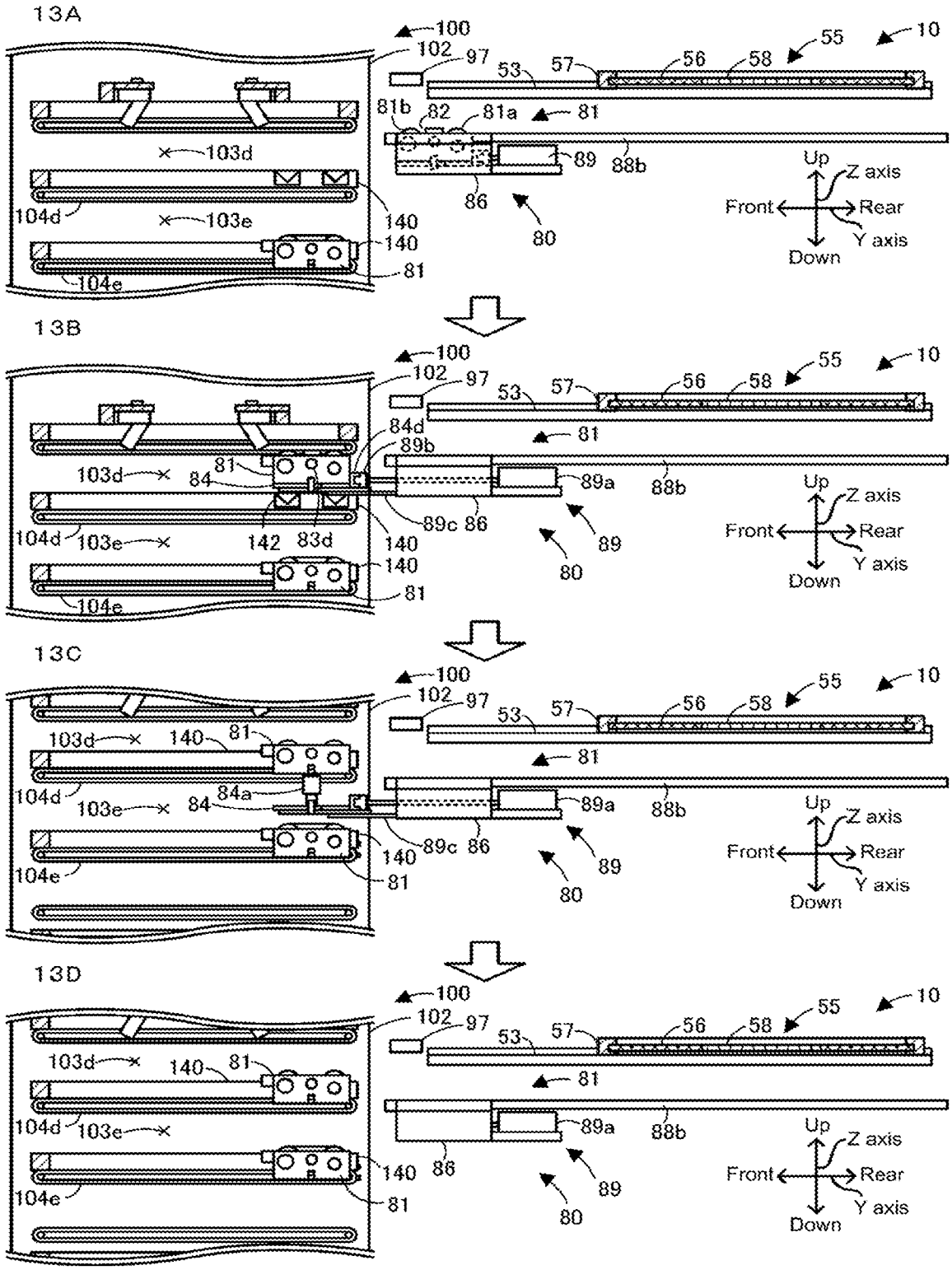
FIG. 13 illustrates a cleaning member unloading process.
Figure 14:
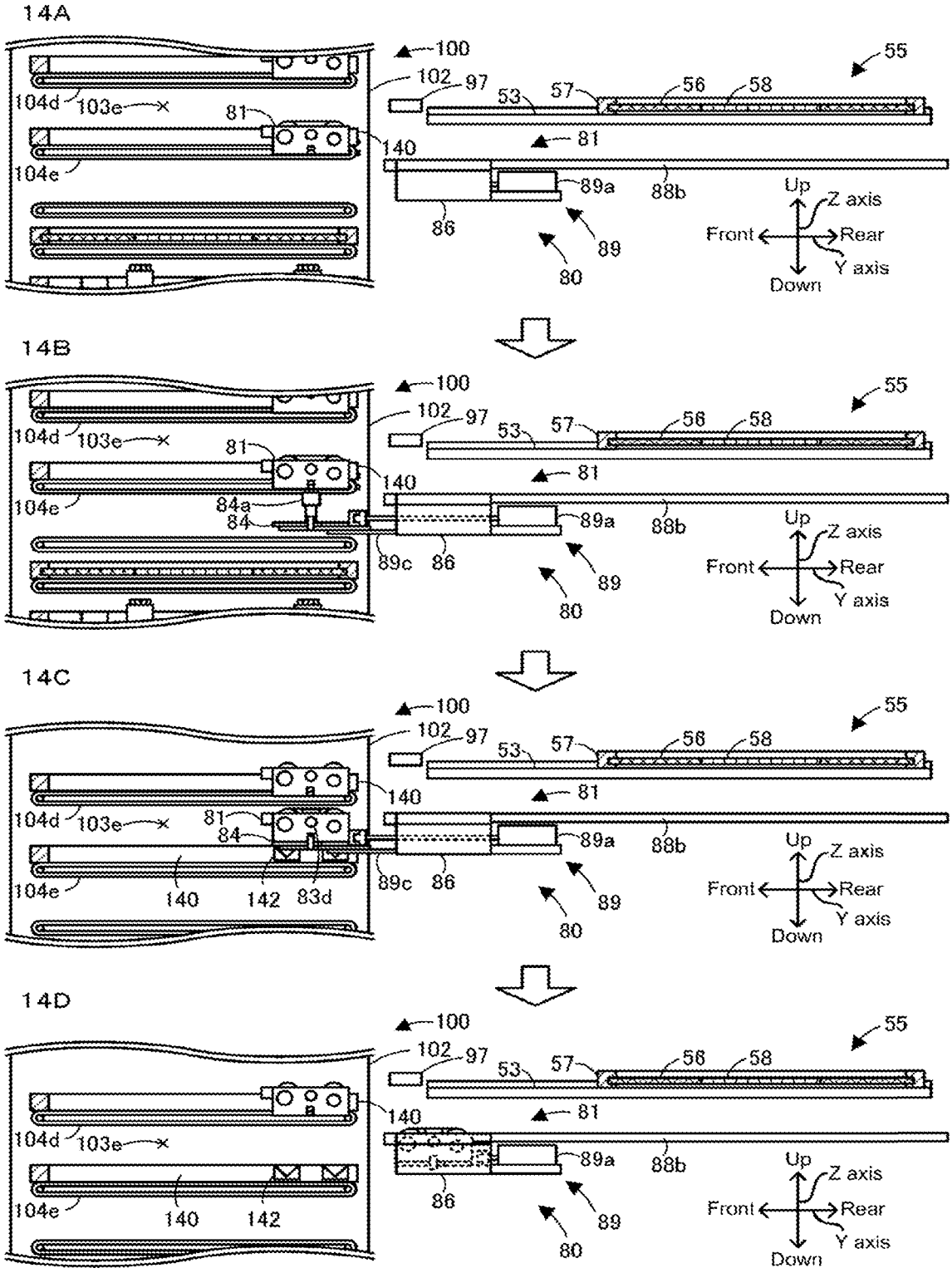
FIG. 14 illustrates a cleaning member loading process.

Described below is cleaning member exchange processing of step S110. When cleaning member exchange processing is started, printing control section 11 performs cleaning member unloading processing of unloading exchange module 81, and cleaning member loading processing of loading exchange-use exchange module 81. FIG. 13 illustrates a cleaning member unloading process. FIG. 14 illustrates a cleaning member loading process. During cleaning member unloading processing, printing control section 11, first, operates conveyor raising and lowering section 105 (FIG. 13A) such that empty cleaning member conveyance jig 140 is positioned at the height for unloading exchange module 81 (unloading height). Here, printing control section 11 raises or lowers fourth conveyance conveyor 104*d* on which the empty cleaning member conveyance jig 140 is loaded to the unloading height. The exchange module 81 unloading height is a height at which protrusion holding sections 142 of cleaning member conveyance jig 140 below protruding sections 83*d* of exchange module 81 attached to loading member 84 are positioned. Further, printing control section 11 controls support member moving mechanism 88 such that exchange module 81 is moved in front of printing apparatus 10 (FIG. 13A). Note that, the position of exchange module 81 at this point may be, for example, a position at the front end of the region in which exchange module 81 can be moved by support member moving mechanism 88, or an initial position of exchange module 81. Next, printing control section 11, by controlling loading member moving mechanism 89 such that loading member 84 is in a protruding state, moves exchange module 81 to a transfer position at which exchange module 81 can be attached to cleaning member conveyance jig 140 (FIG. 13B). In the present embodiment the transfer position is inside accommodation section 102, and printing control section 11 performs operation of moving exchange module 81 to the transfer position and unloading operation of exchange module 81. In this state, the multiple protruding sections 83*d* of exchange module 81 are positioned directly above the multiple protrusion holding sections 142 of cleaning member conveyance jig 140. Continuing, printing control section 11 uses conveyor raising and lowering section 105 to raise accommodation section 102. Thus, protrusion holding sections 142 and protruding sections 83*d* engage, exchange module 81 is attached to cleaning member conveyance jig 140, is raised, and exchange module 81 is removed from loading member 84 (FIG. 13C). Thus, exchange module 81 is unloaded and transferred to cleaning member conveyance jig 140. Then, printing control section 11 moves loading member 84 to the non-protruding state (FIG. 13D).

During cleaning member loading processing, printing control section 11, first, operates conveyor raising and lowering section 105 (FIG. 14A) such that the exchange-use exchange module 81 on conveyance conveyor 104 (here, fifth conveyance conveyor 104*e*) is positioned higher than the height (refer to FIG. 13C) of the top end of loading member 84 (here, the top end of contacting member 84*a*) in a protruding state. Next, printing control section 11, by controlling loading member moving mechanism 89 such that loading member 84 is in a protruding state, moves loading member 84 to a receiving position at which exchange module 81 can be received from cleaning member conveyance jig 140 (FIG. 14B). At this receiving position, loading member 84 is positioned directly below exchange-use exchange module 81. Continuing, accommodation section 102 is lowered such that the cleaning member conveyance jig on fifth conveyance conveyor 104*e* is positioned at a height for loading exchange module 81 (loading height), and is then lowered below the loading height (FIG. 14C). By this, exchange module 81 is attached to loading member 84, and cleaning member conveyance jig 140 is lowered further such that the engaging of protrusion holding sections 142 and protruding sections 83*d* is released. Note that, the exchange module 81 loading height is the height at which exchange-use exchange module 81 is lowered to when attached to loading member 84. Further, printing control section 11, by making loading member 84 into a non-protruding state, loads exchange module 81 inside printing apparatus 10 (FIG. 14D). Thus, exchange module 81 is removed from cleaning member conveyance jig 140 and loaded into printing apparatus 10. When the above cleaning member unloading processing and cleaning member loading processing have been performed, printing control section 11 ends cleaning member exchange processing.

Figure 15:
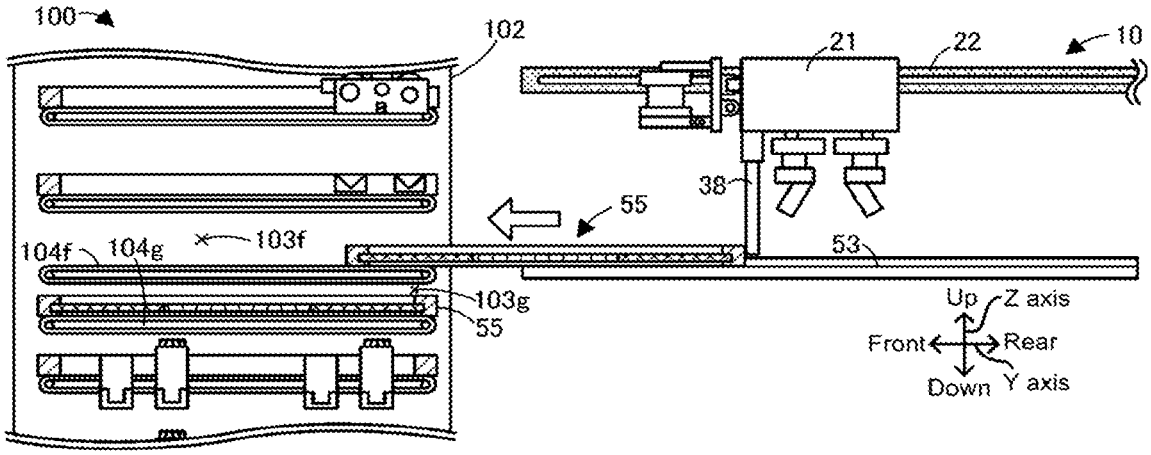
FIG. 15 illustrates a mask unloading process.

Described below is mask unloading processing of step S120. FIG. 15 illustrates a mask unloading process. When mask unloading processing is started, printing control section 11, first, operates conveyor raising and lowering section 105 such that empty conveyance conveyor 104 (here, sixth conveyance conveyor 104*f*) is positioned at the height for unloading screen mask 55 (unloading height). The screen mask 55 unloading height is a position at which sixth conveyance conveyor 104*f* and conveyance rails 53 are at the same height. Next, printing control section 11 makes conveyance rod 38 protrude down and controls printing moving section 22 such that screen mask 55 is moved forwards along conveyance rails 53 (FIG. 15). Further, printing control section 11 uses conveyance rod 38 to convey screen mask 55 to sixth conveyance conveyor 104*f* to unload screen mask 55. Also, printing control section 11 uses sixth conveyance conveyor 104*f* to further move screen mask 55 forwards, so as to accommodate screen mask 55 in accommodation section 102. Thus, screen mask 55 is vacated from conveyance rails 53 such that another conveyance jig can easily be conveyed on conveyance rails 53. Note that, in FIG. 15, conveyance rod 38 performs conveyance by pushing an end (here, the rear end) of screen mask 55 from the outside, but the configuration is not limited to this, for example, screen mask 55 may be conveyed by pushing the inside of frame 57. Similarly, for conveyance of conveyance jigs such as squeegee conveyance jig 110 described later, conveyance rod 38 may push an end of the conveyance jig from the outside, or may push the inside of the conveyance jig (for example, the inside of frame 111) or may push exchangeable member 13 attached to the conveyance jig.

Figure 16:
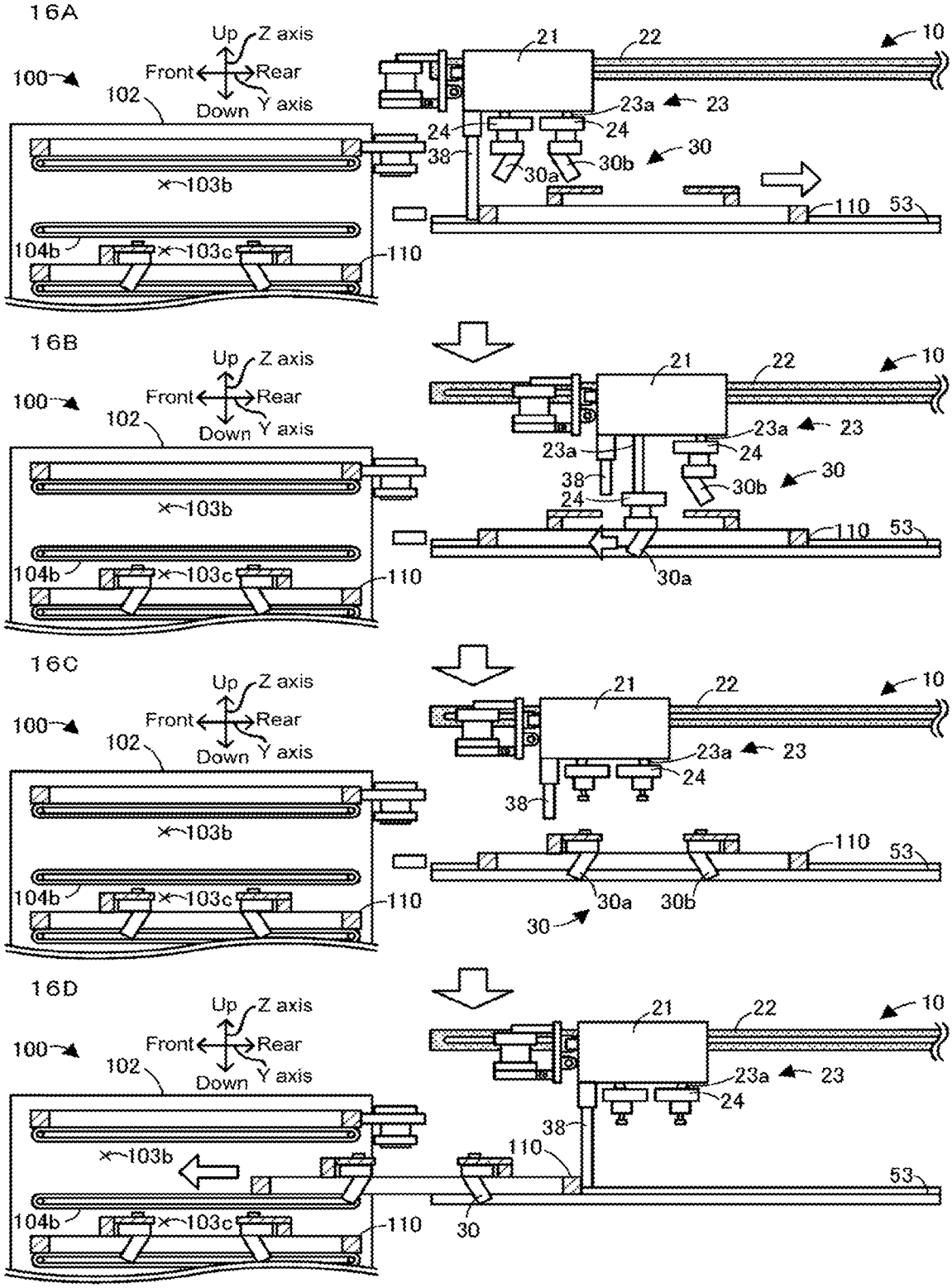
FIG. 16 illustrates a squeegee unloading process.

Described below is squeegee exchange processing of step S130. Upon starting squeegee exchange processing, printing control section 11 performs squeegee unloading processing of unloading squeegee 30, and squeegee loading processing of loading an exchange-use squeegee 30. FIG. 16 illustrates a squeegee unloading process. During squeegee unloading processing, printing control section 11, first, operates conveyor raising and lowering section 105 such that conveyance conveyor 104 on which is loaded squeegee conveyance jig 110 with an empty holder 112 (here, second conveyance conveyor 104*b*) is positioned at the same height as conveyance rails 53 (unloading height). In other words, printing control section 11 positions second conveyance conveyor 104*b* at the same height as the unloading height of screen mask 55 as described above. Further, printing control section 11 controls second conveyance conveyor 104*b* and conveyance rod 38 such that squeegee conveyance jig 110 is loaded inside printing apparatus 10 (FIG. 16A). Next, printing control section 11 controls printing moving section 22 and squeegee raising and lowering section 23 such that first squeegee 30*a* attached to squeegee fixing section 24 moves forwards, and attaches first squeegee 30*a* to empty holder 112 at the front side of squeegee conveyance jig 110 (FIG. 16B). Similarly, printing control section 11 moves second squeegee 30*b* to the rear and attaches second squeegee 30*b* to empty holder 112 at the rear of squeegee conveyance jig 110 (FIG. 16C). Further, printing control section 11 uses conveyance rod 38 to move the squeegee conveyance jig 110 to which squeegee 30 is attached to second conveyance conveyor 104*b*, and unloads the squeegee conveyance jig 110 (FIG. 16D). Also, printing control section 11 uses second conveyance conveyor 104*b* to further move squeegee conveyance jig 110 forwards, so as to accommodate squeegee conveyance jig 110 in accommodation section 102.

During squeegee loading processing, printing control section 11 loads squeegee 30 using a reverse procedure to the squeegee unloading processing described above. In other words, printing control section 11, first, operates conveyor raising and lowering section 105 such that third conveyance conveyor 104*c* on which the squeegee conveyance jig 110 to which an exchange-use squeegee 30 is attached is at the same height as conveyance rails 53 (loading height). Next, printing control section 11 uses third conveyance conveyor 104*c* and conveyance rod 38 to load squeegee conveyance jig 110. Continuing, printing control section 11 controls printing moving section 22 and squeegee raising and lowering section 23 such that the front side squeegee fixing section 24 is moved forwards, and the squeegee 30 attached to the front side holder 112 of squeegee conveyance jig 110 is attached to the front side squeegee fixing section 24. Similarly, printing control section 11 moves rear side squeegee fixing section 24 to the rear and attaches the squeegee 30 attached to the rear side holder 112 of squeegee conveyance jig 110 to the rear side squeegee fixing section 24. Then, printing control section 11 uses conveyance rod 38 to convey the squeegee conveyance jig 110 to which squeegee 30 is attached and uses third conveyance conveyor 104*c* to accommodate squeegee conveyance jig 110 in accommodation section 102.

Figure 17:
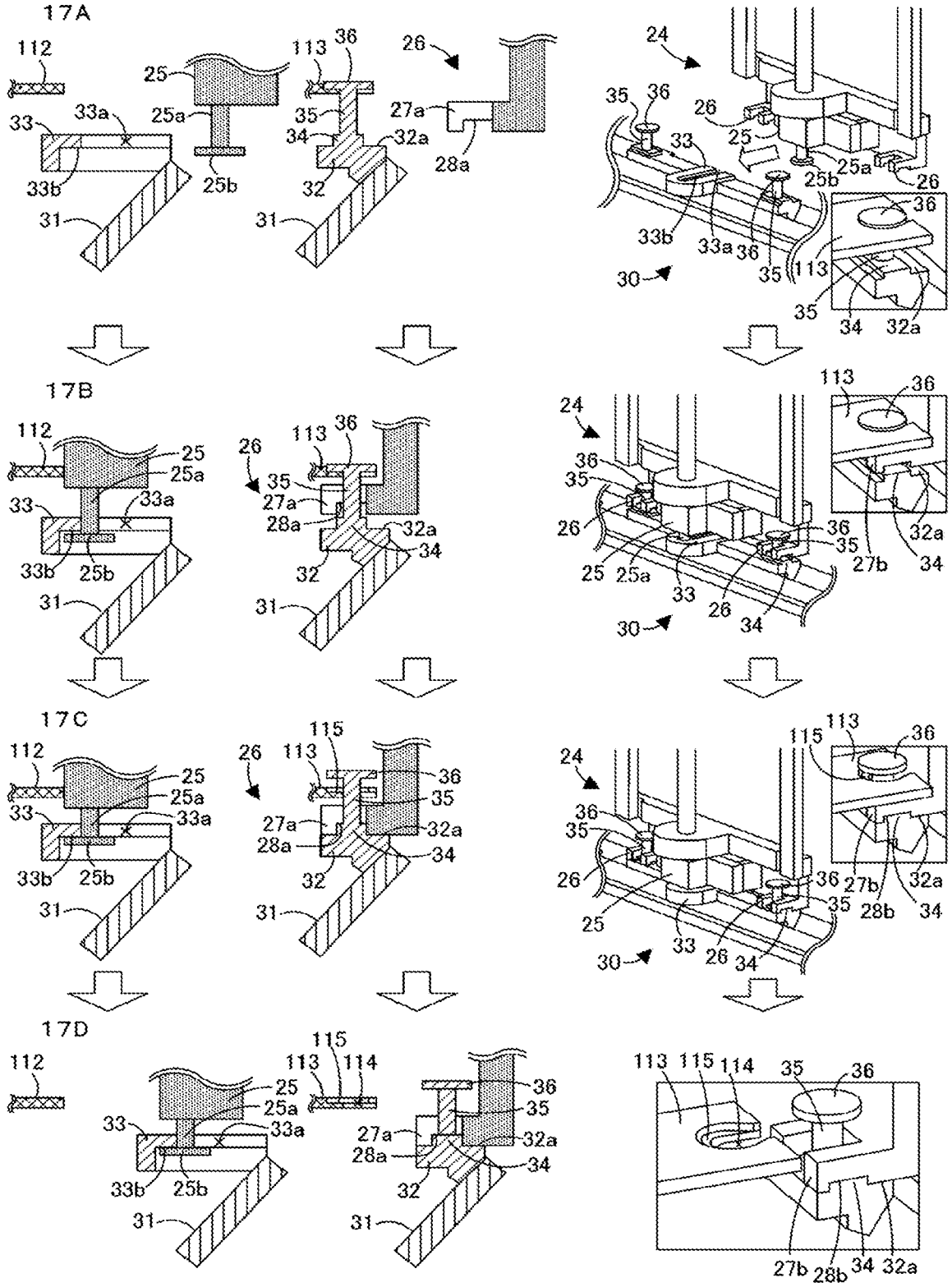
FIG. 17 illustrates operation of mounting squeegee 30 on squeegee fixing section 24.

Details of transfer of squeegee 30 to holder 112 from squeegee fixing section 24, and removal of exchange-use squeegee 30 from holder 112 to squeegee fixing section 24 are described below. Details of removal of squeegee 30 are described first. FIG. 17 illustrates operation of mounting squeegee 30 on squeegee fixing section 24. Note that, FIG. 17 shows a state of the front side squeegee fixing section 24 receiving squeegee 30. Also, the left side of FIG. 17 is a schematic cross section of positioning member 33 and air cylinder 25 along the vertical front-rear direction; the center of FIG. 17 is a schematic cross section of regulating member 26 and shaft member 35 along the vertical front-rear direction; the right side of FIG. 17 is a perspective view from the front top right of squeegee fixing section 24 and squeegee 30. When receiving squeegee 30, printing control section 11, first, lowers squeegee fixing section 24 to release squeegee fixing section 24, and moves squeegee fixing section 24 forwards from the rear of the squeegee 30 that is to be received (FIGS. 16B, 17A). Thus, cylinder shaft 25*a* is inserted into opening section 33*a* of squeegee 30. Here, shaft member 35 of squeegee 30 is inserted between claw sections 27*a* and 27*b* of regulating member 26. Further, cylinder shaft 25*a* contacts positioning member 33 and the forward movement of cylinder shaft 25*a* is regulated by positioning member 33, such that the position of both in the front-rear direction is determined (FIG. 17B). This position is the squeegee 30 receiving position. Note that, in the present embodiment, the receiving position is the position at which the rear surface of positioning member 33 at the opening section 33*a* (the stopping position of opening section 33*a*) and the front surface of cylinder shaft 25*a* contact each other. However, the receiving position may be the position at which flange 25*b* and positioning member 33 contact such that movement to the front of flange 25*b* is regulated by positioning member 33. Also, when squeegee fixing section 24 is positioned at the receiving position, recess 28*a* of regulating member 26 is positioned directly above protruding section 34 of squeegee 30 (FIG. 17B). Continuing, printing control section 11 controls air cylinder 25 such that squeegee fixing section 24 is switched to the fixed state from the released state (FIG. 17C). By this, flange 25*b* is raised to the position of the fixed state, and pushes up held surface 33*b* of positioning member 33. Thus, flange section 36 is pushed up, the engaging of flange section 36 and engaging section 115 of holder 112 is released, and squeegee 30 is moved to the removal position. Also, by this, protruding sections 34 of squeegee 30 are raised up, inserted into recesses 28*a* and 28*b* of squeegee fixing section 24, and engaged with regulating member 26. By the engagement of regulating member 26 and protruding section 34, the movement of squeegee 30 in the front-rear direction with respect to squeegee fixing section 24 is regulated. Also, in the fixed state, held surface 33*b* that is the lower surface of positioning member 33 and held surface 32*a* that is the upper surface of attachment member 32 are configured such that squeegee 30 is fixedly held in squeegee fixing section 24 by being sandwiched between the upper surface of cylinder shaft 25*a* of squeegee fixing section 24 and the lower surface of regulating member 26. Also, printing control section 11 controls printing moving section 22 to move squeegee fixing section 24 to the rear. By this, flange 36 of squeegee 30 passes through opening section 114 and squeegee 30 is completely removed from holder 112 (FIG. 17D). Note that, when exchange-use second squeegee 30*b* is received by squeegee fixing section 24 from the rear side holder 112 of squeegee conveyance jig 110, printing control section 11 may perform the above operation and corresponding reverse operations.

Transfer of squeegee 30 from squeegee fixing section 24 to holder 112 may be performed using a procedure the reverse of the above receiving. When transferring first squeegee 30 to the front side holder 112 of squeegee conveyance jig 110, printing control section 11, first, lowers the front side squeegee fixing section 24, and moves the squeegee fixing section 24 forwards from the rear of holder 112. By this, flange 36 is positioned directly above engaging sections 115 of empty holder 112. This position is the squeegee 30 transfer position. Next, printing control section 11 switches the squeegee fixing section 24 from the fixed state to the released state. By this, engaging sections 115 and flange section 36 engage, squeegee 30 is positioned at the attachment position, and squeegee 30 is attached to holder 112. Also, the engaging of regulating member 26 and protruding sections 34 is released. Further, printing control section 11 moves squeegee fixing section 24 to the rear. Note that, when second squeegee 30*b* is transferred to the rear side holder 112 of squeegee conveyance jig 110, printing control section 11 may perform the above operation and corresponding reverse operations.

Figure 18:
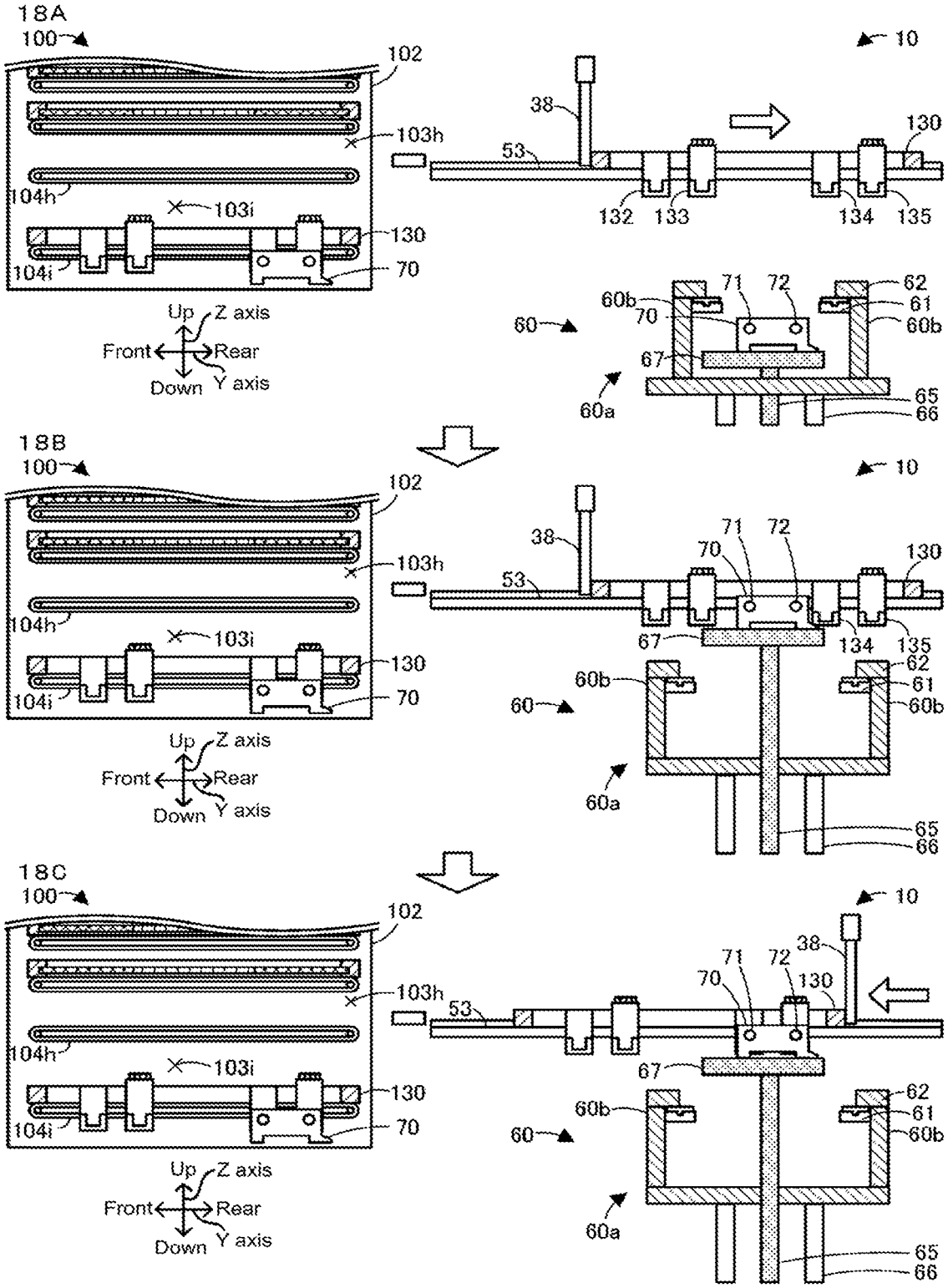
FIG. 18 illustrates a board support member unloading process.
Figure 19:
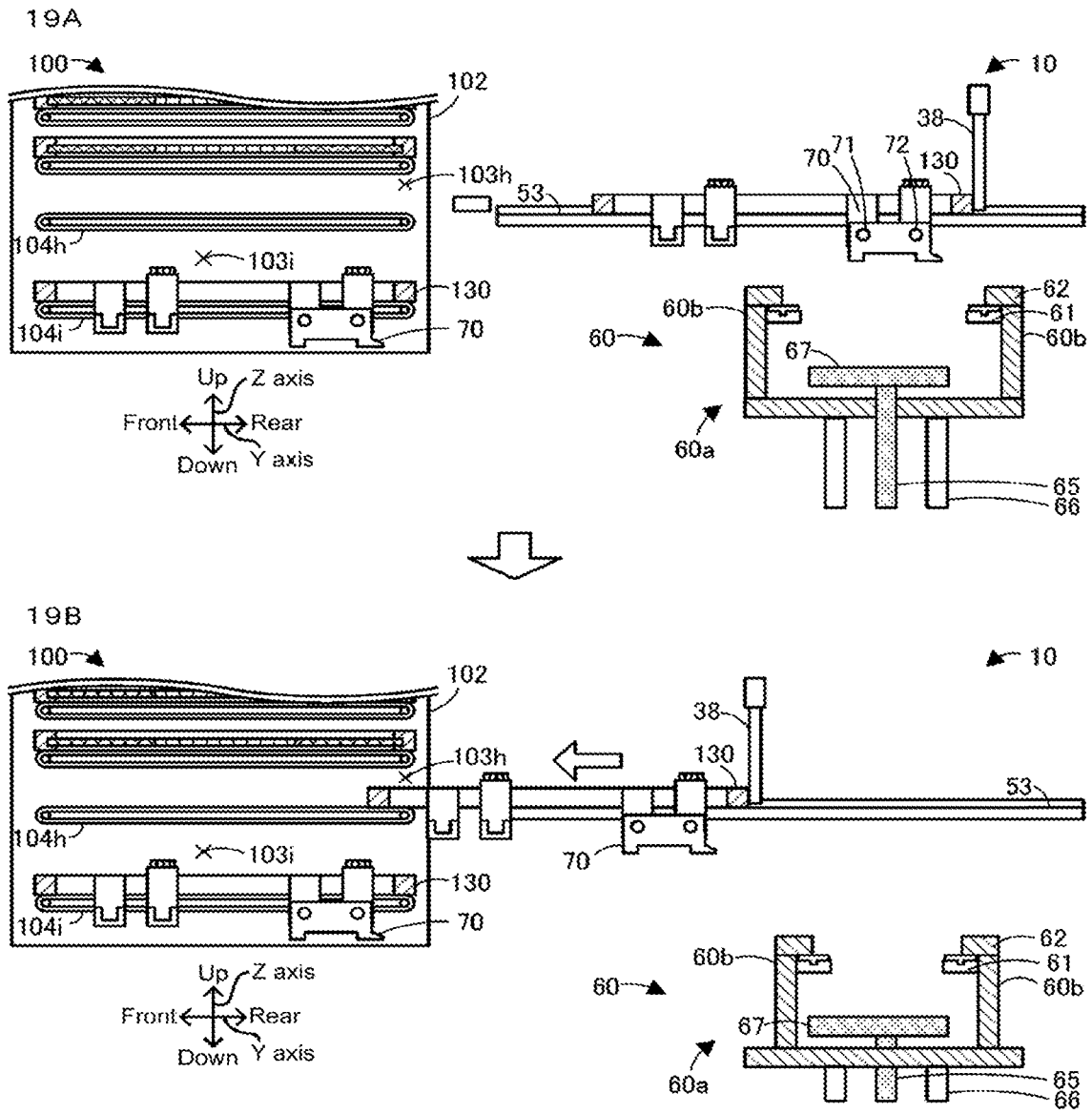
FIG. 19 illustrates a board support member unloading process.

Described below is board support member exchange processing of step S140. When board support member exchange processing is started, printing control section 11 performs board support member unloading processing of unloading board support member 70, and board support member loading processing of loading board support member 70. FIGS. 18 and 19 illustrate a board support member unloading process. During board support member unloading processing, printing control section 11, first, operates conveyor raising and lowering section 105 such that conveyance conveyor 104 (here, eighth conveyance conveyor 104*h*) on which is loaded support member conveyance jig 130 for which at least one of first and second protrusion holding sections 132 and 133 and third and fourth protrusion holding sections 134 and 135 are empty and conveyance rails 53 are at the same height (unloading height). In other words, printing control section 11 positions eighth conveyance conveyor 104*h* at the same height as the unloading height of screen mask 55 as described above. Next, printing control section 11 controls eighth conveyance conveyor 104*h* and conveyance rod 38 such that support member conveyance jig 130 is inserted into printing apparatus 10 (FIG. 18A). Note that, printing control section 11 conveys support member conveyance jig 130 such that the protrusion holding sections (here, third and fourth protrusion holding sections 134 and 135) to which board support member 70 is attached are positioned offset in the front-rear direction (here, to the rear) from directly above protruding sections 71 and 72 of board support member 70. Continuing, printing control section 11 uses board guide moving section 63 to separate the pair of side frames 60*b* in the front-rear direction, and controls support table raising and lowering section 65 and fixing section raising and lowering section 66 to raise board support member 70 (FIG. 18B). By this, protruding sections 71 and 72 of board support member 70 are raised above first to fourth protrusion holding sections 132 to 135. The position of board support member 70 at this point is the board support member 70 transfer position. Continuing, printing control section 11 uses conveyance rod 38 to move support member conveyance jig 130 forwards, such that third and fourth protrusion holding sections 134 and 135 are positioned directly below protruding sections 71 and 72 of board support member 70 (FIG. 18C). Further, printing control section 11 lowers support table 67. By this, board support member 70 is positioned such that protrusion holders 71 and 72 are engaged with third and fourth protrusion holding sections 134 and 135 and becomes attached to support member conveyance jig 130 (FIG. 19A). Then, printing control section 11 lowers board fixing section 60 overall, moves the support member conveyance jig 130 to which the board support member 70 is attached forwards using conveyance rod 38 so as to unload the support member conveyance jig 130 (FIG. 19B). Also, printing control section 11 uses eighth conveyance conveyor 104*h* to further move support member conveyance jig 130 forwards, so as to accommodate support member conveyance jig 130 in accommodation section 102. Note that, printing control section 11 may perform loading processing for the next board support member without lowering board fixing section 60.

Printing control section 11 is able to perform board support member loading processing using a reverse procedure to the above board support member unloading processing. During board support member loading processing, printing control section 11, first, operates conveyor raising and lowering section 105 such that ninth conveyance conveyor 104*i* on which the support member conveyance jig 130 to which an exchange-use board support member 70 is attached is at the same height as conveyance rails 53 (loading height). Next, printing control section 11 uses ninth conveyance conveyor 104*i* and conveyance rod 38 to load support member conveyance jig 130 and convey exchange-use board support member 70 above support table 67. Continuing, printing control section 11 raises support table 67 to raise board support member 70, thereby releasing the engaging of protruding sections 71 and 72 with the protrusion holding sections (here, third and fourth protrusion holding sections 134 and 135). The position of board support member 70 at this point is the board support member 70 receiving position. Then, printing control section 11 moves support member conveyance jig 130 forwards or backwards so as to offset the front-rear positions of protruding sections 71 and 72 and third and fourth protrusion holding sections 134 and 135, and then lowers support table 67. Next, printing control section 11 lowers board fixing section 60 overall, moves the support member conveyance jig 130 forwards using conveyance rod 38 so as to unload the support member conveyance jig 130. Also, printing control section 11 uses ninth conveyance conveyor 104*i* to further move support member conveyance jig 130 forwards, so as to accommodate support member conveyance jig 130 in accommodation section 102.

Described below is mask loading processing of step S150. Printing control section 11 is able to perform mask loading processing using a reverse procedure to the above mask unloading processing. During mask loading processing, printing control section 11, first, operates conveyor raising and lowering section 105 such that conveyance conveyor 104 (here, seventh conveyance conveyor 104*g*) is positioned at the height for loading screen mask 55 (loading height). The screen mask 55 loading height is the same as the screen mask 55 unloading height. Next, printing control section 11 uses seventh conveyance conveyor 104*g* and conveyance rod 38 to convey exchange-use screen mask 55 to the rear so as to load exchange-use screen mask 55. When the above steps 100 to S150 have been performed, printing control section 11 ends the exchange processing routine.

Printing apparatus 10 of the present embodiment described above, is provided with a moving section configured to perform at least one of moving an exchangeable member 13 to an exchange position or loading and unloading of the exchangeable member 13, for at least two types (in the present embodiment, five types) of exchangeable members 13 that, out of cartridge 49, squeegee 30, cleaning member 82, screen mask 55, board support member 70, include at least one of the cartridge 49, the squeegee 30, and the cleaning member 82. In more detail, the moving section is provided with: printing moving section 22 and supply moving section 46 that perform moving of cartridge 49 to the exchange position and loading and unloading of cartridge 49; printing moving section 22 and squeegee raising and lowering section 23 that move squeegee 30 to the exchange position; and printing moving section 22, conveyance rod 38, and conveyance rails 53 that perform loading and unloading of squeegee 30. Also, the moving section is provided with: cleaning moving section 87 that performs moving of cleaning member 82 to the exchange position and loading and unloading of cleaning member 82; printing moving section 22, conveyance rod 38, and conveyance rails 53 that perform loading and unloading of screen mask 55; support table raising and lowering section 65 and fixing section raising and lowering section 66 that perform moving of board support member 70 to the exchange position; and printing moving section 22, conveyance rod 38, and conveyance rails 53 that perform loading and unloading of board support member 70. Also, printing apparatus 10 is provided with printing control section 11 that performs exchange processing of controlling the moving section to perform exchanging of exchangeable members 13. Accordingly, printing apparatus 10 is able to perform automatic exchange of at least two types (in the present embodiment, five types) of exchangeable members 13.

Also, in printing apparatus 10, the moving section includes a shared moving mechanism configured to move at least two types of the exchangeable members 13. Specifically, printing moving section 22 is a shared moving mechanism for moving cartridge 49, squeegee 30, screen mask 55, and board support member 70. Conveyance rod 38 and conveyance rails 53 is a shared moving mechanism for moving squeegee 30, screen mask 55, and board support member 70. Therefore, printing apparatus 100 is able to perform automatic exchange of each of the at least two types of members among the exchangeable members 13 using the same moving mechanism. Thus, printing apparatus 10 can have a more compact configuration than, for example, a case in which a separate moving mechanism is provided for each type of exchangeable member 13.

Further, printing apparatus 10 is provided with reading section 97 shared between the at least two types of exchange members 13 for reading barcodes 57*a*, 116, 126, 136, and 146 affixed to at least one of the exchangeable members or the conveyance jigs of the exchangeable members (in the present embodiment, screen mask 55 and conveyance jigs 110, 120, 130, and 140). Thus, printing apparatus 10 is able to identify the exchangeable members 13 by reading the barcodes, enabling exchange processing to be performed more appropriately. Also, because printing apparatus 10 is able to read the barcode of each of the at least two types of members (in the present embodiment, all five types) using the same reading section 97, printing apparatus 10 can have a more compact configuration than, for example, a case in which a separate reading section is provided for each type of exchangeable member 13.

Further, printing apparatus 10 is configured such that loading and unloading of exchangeable members 13 is possible to and from accommodation apparatus 100 configured to accommodate the exchangeable members 13, and exchange control section 11 is configured to cause reading section 97 to read identification information of at least one type of the exchangeable members 13 accommodated in accommodation apparatus 100 during printing. Thus, printing apparatus 10 is able to read the at least one type of barcode 57*a*, 116, 126, 136, or 146 of the exchangeable members 13 before exchange processing. Therefore, printing apparatus 10 is able to perform exchange processing in a shorter time compared to a case of reading all the barcodes during exchange processing.

Further, printing control section 11 is configured to, when the reading section 97 reads the barcode of the at least one type of exchangeable member 13, output a command to accommodation apparatus 100 such that the exchangeable member 13 accommodated in accommodation apparatus 100 is moved to a position at which the barcode can be read by reading section 97. Accordingly, even in a case in which reading section 97 cannot read the barcode 57*a*, 116, 126, 136, or 146 while accommodated inside accommodation apparatus 100, printing control section 11 can move the exchangeable member 13 in accommodation apparatus 100 such that reading section 97 can read each barcode 57*a*, 116, 126, 136, and 146. Also, because reading of barcodes is performed during printing, even if accommodation apparatus 100 moves exchangeable member 13 for reading, there is little effect on the time required for exchange processing.

Further, as described above, accommodation apparatus 100 is provided with accommodation section 102 that accommodates exchangeable members 13, and conveyance conveyors 104 that perform loading and unloading of the at least one type of exchangeable member 13 (in the present embodiment, the three types of squeegee 30, screen mask 55, and board support member 70) to and from accommodation section 102 and printing apparatus 10. Thus, printing apparatus 10 is able to perform transfer of exchangeable members 13 to and from accommodation apparatus 100 rather than an operator, which makes it easier for printing apparatus 10 to automate exchange of exchangeable members 13. Further, printing control section 11 performs loading and unloading with a mechanism at the printing apparatus 10 side for cartridge 49 and exchange module 81 for which loading and unloading are not performed using conveyance by conveyance conveyor 104.

Also, accommodation apparatus 100 is provided with conveyor raising and lowering section 105 that raises and lowers accommodation section 102, and accommodation section 102 includes nine levels of accommodation regions 103 in the vertical direction for accommodating at least one type (in the present embodiment, all five types) of the exchangeable members 13. Accordingly, since exchangeable members 13 can be accommodated in each of the multiple accommodation regions 103*a* to 103*i*, it is easy for accommodation section 102 to accommodate at least two types of exchangeable members 13. Also, since conveyor raising and lowering section 105 is able to adjust the height of exchangeable member 13 during transfer of exchangeable member 13 to and from printing apparatus 10, accommodation apparatus 100 is able to perform transfer of exchangeable member 13 at an appropriate height for each printing apparatus 10 and each type of exchangeable member 13.

Further, accommodation section 102 accommodates the exchangeable member 13 for which the loading height to printing apparatus 10 was the highest among the exchangeable members 13 (here, cartridge 49), in the top level of the multiple accommodation regions 103. Accordingly, compared to a case in which, for example, cartridge 49 for which the loading height is the highest is accommodated in a region other than the topmost first accommodation region 103*a*, it is easier to make the raising and lowering range required for conveyor raising and lowering section 105 smaller.

Further, accommodation section 102 accommodates exchange module 81 including cleaning member 82 in a state attached to protrusion holding sections 142 of cleaning member conveyance jig 140, and conveyor raising and lowering section 105, by raising or lowering cleaning member conveyance jig 140 by the raising or lowering of accommodation section 102, attaches exchange module 81 received (transferred) from printing apparatus 10 to cleaning member conveyance jig 140. Also, conveyor raising and lowering section 105, by raising or lowering cleaning member conveyance jig 140 by the raising or lowering of accommodation section 102, removes the exchange module 81 attached to cleaning member conveyance jig 140 from cleaning member conveyance jig 140 and transfers it to printing apparatus 10. Thus, conveyor raising and lowering section 105 is able to also act as the mechanism for performing receiving and transfer of exchange module 81 to and from accommodation apparatus 100 and printing apparatus 10.

Meanwhile, it goes without saying that the present disclosure is not limited to the above-mentioned embodiment and various embodiments may be applied within the technical scope of the present disclosure.

For example, in an embodiment above, accommodation section 102 accommodates cartridge 49 for which the loading height to printing apparatus 10 is the highest among the exchangeable members 13 in the topmost first accommodation region 103*a*, but the configuration is not limited to this. Also, accommodation section 102 may accommodate the exchangeable member 13 for which the loading height to the printing apparatus 10 is the lowest in the lowest of the multiple accommodation regions. For example, cleaning member 82 may be accommodated in the ninth accommodation region 103*i* of ninth conveyance conveyor 104*i*.

In an embodiment above, printing control section 11 performs reading processing during printing, but the configuration is not limited to this. For example, printing control section 11 may perform reading processing before steps S100 to S150 when performing the exchange processing of FIG. 11. Alternatively, printing control section 11, instead of performing reading processing, may receive information related to exchangeable members 13 and conveyance jigs accommodated in accommodation section 102 from management PC 150, or from an operator via inputs into display operation section 98. Also, it may be decided as a rule to accommodate an empty conveyance jig in one of the accommodation regions 103 in advance, or to accommodate any of the types of exchangeable members 13 in any of the accommodation regions 103 in advance. In this case, printing control section 11 may memorize that rule in advance, and printing control section 11 does not have to perform reading processing if an operator accommodates the conveyance jigs and exchangeable members 13 in the accommodation region 103 in accordance with the rule.

In an embodiment above, printing apparatus 10 is provided with reading section 97, but the configuration is not limited to this, for example, accommodation apparatus 100 may be provided with reading section 97. In this case, instead of printing control section 11, accommodation control section 106 may perform the above reading processing, and output the acquired information to printing control section 11. In this case too, it is possible for accommodation control section 106 to perform reading processing without stopping printing processing by printing control section 11.

In the present embodiment above, with regard to exchangeable members 13 conveyed using a conveyance jig, a barcode is affixed to the conveyance jig, but the configuration is not limited to this, and the barcode may be affixed to the exchangeable member 13. Also, in the present embodiment above, a barcode is affixed to the conveyance jigs and screen mask 55, but the configuration is not limited to a barcode, a different type of 2D code or the like may be affixed.

In an embodiment above, printing apparatus 10 includes printing moving section 22 as a shared mechanism for moving four types of the five types of exchangeable members 13, but the configuration is not limited to this, and the moving mechanism may be shared for all five types. For example, the switching of module 81 and loading member 84 to and from a protruding state and a non-protruding state is performed by loading member moving mechanism 89, but this switching may be performed by conveyance rod 38. For example, the configuration may be such that conveyance rod 38 protrudes down to the same height as exchange module 81, and by using printing moving section 22 to move conveyance rod 38 to the front or rear, switching may be performed to and from the protruding state and the non-protruding state. In this case, printing moving section 22 is the shared moving mechanism for moving all five types of the exchangeable members 13. Also, printing apparatus 10 may include a shared moving mechanism (for example, printing moving section 22, conveyance rod 38, and conveyance rails 53) for moving at least two types of the members including squeegee 30 among squeegee 30, screen mask 55, and board support member 70. Alternatively, printing apparatus 10 may include a shared moving mechanism (for example, printing moving section 22 and conveyance rod 38) for moving at least two types of the members including at least one of squeegee 30 and cleaning member 82 among squeegee 30, screen mask 55, board support member 70, and cleaning member 82.

In an embodiment above, printing control section 11 performs mask unloading processing before performing squeegee exchange processing during the exchange processing routine, but the configuration is not limited to this. For example, in a case in which it is possible to perform transfer of squeegee 30 with squeegee conveyance jig 110 and squeegee fixing section 24 in a region in front of screen mask 55 without retracting screen mask 55, printing control section 11 does not have to perform mask unloading processing before squeegee exchange processing.

Descriptions were not given for an embodiment above, but when starting the exchange processing routine, printing control section 11 may determine whether all the required exchange-use exchangeable members 13 are accommodated in accommodation apparatus 100 based on information read during reading processing. Further, printing control section 11 may, upon determining that a required exchange-use exchangeable member 13 is not accommodated, output error information indicating that fact to at least one of display operation section 98 or management PC 150, so as to report to an operator that an exchangeable member 13 is missing. Note that, printing control section 11 may perform exchange processing of a type of exchange member 13 different to the missing type in the event of determining that a required exchange-use exchangeable member 13 is missing. For example, printing control section 11, in a case in which exchange-use cartridge 49 is not accommodated in accommodation apparatus 100, may perform exchange processing for another of the four types of exchange members 13 if exchange processing for one of those four types is required. Accordingly, while the operator prepares the missing exchangeable member 13, exchange processing can be performed for another exchangeable member 13.

In an embodiment described above, accommodation apparatus 100 is provided with accommodation control section 106, and printing control section 11 controls accommodation apparatus 100 indirectly by outputting commands to accommodation control section 106, but the configuration is not limited to this and accommodation control section 106 may be omitted. In this case, for example, printing control section 11 may directly control conveyance conveyor 104 and conveyor raising and lowering section 105 via communication.

In an embodiment above, accommodation apparatus 100 is provided with a moving section and can be moved by an operator, but the configuration is not limited to this and a moving section does not have to be provided. Also, accommodation apparatus 100 may be configured from an AGV (Automatic Guided Vehicle) that can travel autonomously and is provided with a drive mechanism for driving a moving section. In this case, accommodation apparatus 100 may move to a location at which exchange-use exchangeable member 13 is stored and may automatically accommodate exchange-use exchangeable member 13 in accommodation section 102.

In an embodiment above, descriptions were given mainly for exchange of an exchangeable member 13 during changeover, but the timing for exchange is not limited to this. For example, for consumables such as cartridge 49 and cleaning member 82, for example, printing control section 11 may perform exchange processing when a sensor that detects a remaining amount detects that a consumable has been depleted.

In an embodiment above, printing apparatus 10 performed automatic exchange with accommodation apparatus 100 for all five types of exchangeable members 13, but the configuration is not limited to this. For example, for at least one type of exchangeable member 13, printing apparatus 10 itself may have at least two holders capable of having an exchange-use exchangeable member 13 attached. In this case, an operator may attach exchange-use exchangeable member 13 to at least one holder in advance, and leave at least one holder empty in advance, such that printing apparatus 10 is able to perform automatic exchange between the holders. Thus, printing apparatus 10 is able to perform exchange processing for at least one of the exchangeable members 13 irrespective of unloading and loading.

In an embodiment above, accommodation apparatus 100 accommodated exchangeable members 13 except for screen mask 55 inside accommodation section 102 in a state attached to a conveyance jig, but they may be accommodated in a state attached to a holder. For example, accommodation apparatus 100 may accommodate at least one type of exchangeable member 13 except for screen mask 55 in a state attached to a holder that cannot be conveyed by conveyance conveyor 104. In this manner too, printing apparatus 10, if including a mechanism that performs transfer of exchangeable member 13 to and from accommodation apparatus 100, may perform automatic exchange in a similar manner to an above embodiment. For example, with accommodation apparatus 100 of an embodiment described above, for cartridge 49 and exchange module 81, accommodation apparatus 100 is able to perform automatic exchange without performing movement to the front or rear, thus, at least one of cartridge 49 and exchange module 81 may be attached to a fixed holder rather than a conveyance jig.

In an embodiment above, printing apparatus 10 is configured to be able to perform automatic exchange of all five types of exchangeable members 13, but the configuration is not limited to this and printing apparatus 10 may be configured to perform automatic exchange of only at least one type of exchange members 13 including at least one type other than screen mask 55. Also, in a case in which printing apparatus 10 is able to perform automatic exchange of two to four of the five types of exchangeable members 13, the combination of which of the five types of exchangeable members 13 are to be exchanged automatically may be selected. Further, the configuration may be such that an operator does not perform exchange of the member (that is, the member is not an exchangeable member) for at least one and up to four types of the five types of exchangeable members 13. Also, printing apparatus 10 may be configured without at least one of the five types of exchangeable members 13. For example, printing apparatus 10 may be configured without cleaning section 80 that includes cleaning member 82.

A printing apparatus and an accommodation apparatus of the present disclosure may be configured as described below.

Also, in a printing apparatus of the present disclosure, the moving section may include a shared moving mechanism configured to move at least two types of the exchangeable members. Accordingly, the printing apparatus may perform automatic exchange of each of the at least two types of members among the exchangeable members using the same moving mechanism. Thus, the printing apparatus can have a more compact configuration than, for example, a case in which a separate moving mechanism is provided for each type of exchangeable member.

A printing apparatus of the present disclosure may further include a reading section configured to read identification information provided on at least one of the members or a member conveyance jig, use of the reading section being shared for the at least two types of the members included in the exchangeable members. Thus, the printing apparatus may identify the exchangeable members by reading the identification information, enabling exchange processing to be performed more appropriately. Also, because the printing apparatus is able to read the identification information of each of the at least two types of members using the same reading section, the printing apparatus can have a more compact configuration than, for example, a case in which a separate reading section is provided for each type of exchangeable member.

In this case, the printing apparatus may be configured such that loading and unloading of the exchangeable members is possible to and from an accommodation apparatus configured to accommodate the exchangeable members, and the exchange control section may be configured to cause the reading section to read, during printing, identification information of at least one type of the exchangeable members accommodated in the accommodation apparatus. Thus, this printing apparatus may read in advance the identification information of at least one type of the exchangeable members before exchange processing. Therefore, the printing apparatus is able to perform exchange processing in a shorter time compared to a case of reading the identification information of all the exchangeable members during exchange processing.

In this case, the exchange control section may be configured to, when making the reading section read the identification information of the at least one type of exchangeable member during printing, output a command to the accommodation apparatus such that the exchangeable member accommodated in the accommodation apparatus is moved to a position at which reading by the reading device is possible. Accordingly, even in a case in which the reading section cannot read the identification information while accommodated inside the accommodation apparatus, the printing control section can move the exchangeable member in the accommodation apparatus such that the reading section can read the identification information. Also, because reading of identification information is performed during printing, even if the accommodation apparatus moves the exchangeable member for reading, there is little effect on the time required for exchange processing.

An accommodation apparatus of the disclosure includes: an accommodation section configured to accommodate exchangeable members that are used in a printing apparatus for performing printing of a viscous fluid onto a print target using a screen mask, the exchangeable members being a cartridge configured to house the viscous fluid, a squeegee, a screen mask, a cleaning member used to clean the screen mask, and a support member configured to fix the print target, and the accommodation section being configured to accommodate at least two types of the exchangeable members including at least one of the cartridge, the squeegee, and the cleaning member; and a conveyance section configured to perform loading and unloading of at least one type of the exchange members to and from the accommodation section and the printing apparatus.

The accommodation apparatus accommodates at least two types of exchangeable members and performs loading and unloading of at least one type of the exchangeable members to and from the printing apparatus. Thus, the printing apparatus is able to perform transfer of exchangeable members to and from the accommodation apparatus rather than an operator, which makes it easier for the printing apparatus to automate exchange of exchangeable members. This accommodation apparatus may perform transfer of exchangeable members to and from the printing apparatus of the disclosure according to one of the embodiments described above. Note that, in a case in which there is an exchangeable member for which the conveyance section of the accommodation apparatus does not perform conveyance, conveyance of that exchangeable member may be performed by a configuration on the printing apparatus side.

The accommodation apparatus of the disclosure may further include a raising and lowering section configured to raise and lower the accommodation section, wherein the accommodation section includes multiple levels in a vertical direction of accommodation regions configured to accommodate at least one type of the exchangeable members. Accordingly, since exchangeable members can be accommodated in each of the multiple accommodation regions, it is easy for the accommodation section to accommodate at least two types of exchangeable members. Also, since the raising and lowering section is able to adjust the height of the exchangeable member during transfer of the exchangeable member to and from the printing apparatus, the accommodation apparatus is able to perform transfer of exchangeable member at an appropriate height for each printing apparatus and each type of exchangeable member.

In this case, the accommodation section may be configured to perform at least one of, among the exchangeable members, accommodating the member for which a loading height to the printing apparatus is highest at a topmost accommodation region among the multiple levels of accommodation regions, and, among the exchangeable members, accommodating the member for which the loading height to the printing apparatus is lowest at a bottommost accommodation region among the multiple levels of accommodation regions. Accordingly, compared to a case in which, for example, a member for which the loading height is the highest is accommodated in a region other than the topmost accommodation region, it is easier to make the raising and lowering range required for the raising and lowering section smaller. Similarly, compared to a case in which, for example, a member for which the loading height is the lowest is accommodated in a region other than the bottommost accommodation region, it is easier to make the raising and lowering range required for the raising and lowering section smaller.

The accommodation apparatus of the present disclosure may further include a raising and lowering section configured to raise and lower the accommodation section, wherein the accommodation section is configured to accommodate at least one type of the member out of the exchangeable members in a state attached to a holder, and the raising and lowering section is configured to perform at least one of, by raising or lowering the holder by raising or lowering the accommodation section, attaching the exchangeable member received from the printing apparatus to the holder, and removing the exchangeable member attached to the holder from the holder and transferring the exchangeable member to the printing apparatus. Thus, raising and lowering section that raises and lowers the accommodation section is able to also act as the mechanism for performing receiving and transfer of an exchangeable member to and from the accommodation apparatus and the printing apparatus. Note that, the holder may be fixed in the accommodation section or may be configured to move. For example, an exchangeable member may be attached to a holder including a conveyance jig capable of being moved by the conveyance section.

INDUSTRIAL APPLICABILITY

The present disclosure may be applied to a printing apparatus that prints a viscous fluid onto a print target such as a board.

REFERENCE SIGNS LIST

1: printing system;
10: printing apparatus;

11: printing control section;
13: exchangeable member;
20: print process section;
21: printing head;
22: printing moving section;
23: squeegee raising and lowering section;
23*a*: piston rod;
24: squeegee fixing section;
25: air cylinder;
25*a*: cylinder shaft;
25*b*: flange;
26: regulating member;
27*a*, 27*b*: claw section;
28*a*, 28*b*; recess;
30: squeegee;
30*a*, 30*b*: first and second squeegee;
31: squeegee blade;
32: attachment member;
32*a*: held surface;
33: positioning member;
33*a*: opening section;
33*b*: held surface;
34: protruding section;
35: shaft member;
36: flange section;
38: conveyance rod;
40: supply section;
41: supply head;
41*a*: rear plate section;
41*b*: fixing member;
42: air supply section;
43: clamp section;
44: rotation motor;
45: remaining amount sensor;
46: supply moving section;
46*a*: guide;
46*b*: ball screw;
48: driving motor;
49: cartridge;
49*a*: main body section;
49*b*: flange section;
49*d*: connecting section;
50: mask work section;
51: mask fixing section;
52: position adjusting section;
53: conveyance rail;
55: screen mask;
56: mask main body;
57: frame;
57*a*: barcode;
58: hole pattern;
60: board fixing section;
60*a*: main body;
60*b*: side frame;
61: board conveyance conveyor;
62: board guide;
63: board guide moving section;
65: support table raising and lowering section;
66: fixing section raising and lowering section;
67: support table;
70: board support member;
70*a*: main body section;
71, 72: protrusion;
73: suction opening;
75: identification section;
76: barcode;
80: cleaning section;
81: exchange module;
81*a*: first roller;
81*b*: second roller;
82: cleaning member;
83: attachment member;
83*a*: case body;
83*b*: shaft receiver;
83*c*: gear;
83*d*: protruding section;
83*e*: receiving member;
83*f*: opening section;
83*g*: engaging shaft;
84: loading member;
84*a*: contacting member;
84*b*: raising and lowering device;
84*c*: claw member;
84*d*: connecting section;
86: support member;
86*a*: winding motor;
86*b*: gear;
86*c*: lock mechanism;
86*d*: lock member;
87: cleaning moving section;
88: support member moving mechanism;
88*a*: Y-axis slider;
88*b*: guide rail;
89: loading member moving mechanism;
89*a*: drive source;
89*b*: connecting section;
89*c*: expansion rail;
97: reading section;
98: display operation section;
100: accommodation apparatus;
101: housing;
102: accommodation section;
103: accommodation region;
103*a* to 103*i*: first to ninth accommodation regions;
104: conveyance conveyor;
104*a* to 104*i*: first to ninth conveyance conveyors;
105: conveyor raising and lowering section;
106: accommodation control section;
110: squeegee conveyance jig;
111: frame;
112: holder;
113: support section;
114: opening section;
115: engaging section;
116: barcode;
120: cartridge conveyance jig;
121: frame;
122: holder;
123: support section;
124: opening section;
125: engaging section;
126: barcode;
130: support member conveyance jig;
131: frame;
132 to 135: first to fourth protrusion holding section;
136: barcode;
140: cleaning member conveyance jig;
141: frame;
142: protrusion holding section;
146: barcode;
150: management PC;
S: board

The invention claimed is:

1. A printing apparatus for performing printing of a viscous fluid onto a print target using a screen mask, the printing apparatus comprising:

a plurality of exchangeable members including at least two of a cartridge configured to house the viscous fluid, a squeegee, a screen mask, a cleaning member used to clean the screen mask, and a support member configured to fix the print target the plurality of exchangeable members including at least one of the cartridge, the squeegee, and the cleaning member;

a moving section configured to perform at least one of loading and unloading one exchangeable member of the plurality of exchangeable members, the moving section including a printing head that is movable in a horizontal direction and a conveyance rod provided in the printing head and movable in a vertical direction;

a mask work section including a mask fixing section which positions the screen mask, and a conveyance rail which guides the screen mask, the mask work section being disposed below the moving section;

a board fixing section provided below the mask work section, the board fixing section configured to move the print target towards and away from the screen mask and including a support table on which the support member is arranged;

a cleaning section configured to clean a lower surface of the screen mask and provided between the mask work section and the board fixing section in the vertical direction, the cleaning section including a cleaning module including the cleaning member and capable of exchanging the cleaning member;

an accommodation apparatus including an accommodation section configured to accommodate the plurality of exchangeable members, the accommodation section being provided with a plurality of conveyance conveyors provided at multiple levels in the vertical direction, each of the conveyance conveyors to perform loading and unloading of one of the plurality of exchangeable members to and from the accommodation section; and a raising and lowering section configured to raise and lower the accommodation section; and a controller configured to perform exchange processing of exchanging the one exchangeable member, the controller configured to move the raising and lowering section such that one of the conveyance conveyors of the plurality of conveyance conveyors corresponding to the one exchangeable member is at an exchange height, move the moving section to move the one exchangeable member to an exchange position, and perform the exchange of the one exchangeable member.

2. The printing apparatus according to claim 1, further including a reading section configured to read identification information provided on each exchangeable member of the plurality of exchangeable members.

3. The printing apparatus according to claim 2, wherein the controller is configured to cause the reading section to read, during printing, the identification information of a target member for exchange accommodated in the accommodation apparatus.

4. The printing apparatus of claim 3, wherein the controller is configured to, when making the reading section read the identification information of the target member for exchange, output a command to the accommodation apparatus such that the target member for exchange accommodated in the accommodation apparatus is moved to a reading position.

5. The printing apparatus according to claim 1, wherein the accommodation section is configured to accommodate one of the exchangeable members in a state attached to a holder.

6. The printing apparatus according to claim 1, wherein during the exchange of the one exchangeable member, the controller is configured to move the moving section such that the conveyance rod moves the one exchangeable member to the one of the conveyance conveyors of the plurality of conveyance conveyors.

* * * * *